US011278750B1

(12) United States Patent
Acomb

(10) Patent No.: US 11,278,750 B1
(45) Date of Patent: Mar. 22, 2022

(54) PAPR FRAME

(71) Applicant: Donald Acomb, Tucson, AZ (US)

(72) Inventor: Donald Acomb, Tucson, AZ (US)

( * ) Notice: Subject to any disclaimer, the term of this patent is extended or adjusted under 35 U.S.C. 154(b) by 0 days.

(21) Appl. No.: 17/379,054

(22) Filed: Jul. 19, 2021

Related U.S. Application Data

(60) Provisional application No. 63/150,180, filed on Feb. 17, 2021.

(51) Int. Cl.

| | |
|---|---|
| ***A62B 9/04*** | (2006.01) |
| ***A41D 13/11*** | (2006.01) |
| ***G10K 11/16*** | (2006.01) |
| ***A62B 7/10*** | (2006.01) |
| ***A62B 7/12*** | (2006.01) |

(52) U.S. Cl.
CPC ..... *A62B 9/04* (2013.01); *A41D 13/1184* (2013.01); *A62B 7/10* (2013.01); *A62B 7/12* (2013.01); *G10K 11/161* (2013.01)

(58) Field of Classification Search
CPC ..... A62B 7/00–02; A62B 7/06–12; A62B 9/00–006; A62B 9/04; A62B 18/00–006; A62B 18/08–18/082; A62B 23/00–02; A41D 13/11–1107; A41D 13/1161; A41D 13/1184; G10K 11/161; A42B 3/24; A42B 3/28–286; A61F 9/04–06; A61F 9/068
See application file for complete search history.

(56) References Cited

U.S. PATENT DOCUMENTS

| | | | | |
|---|---|---|---|---|
| 3,223,086 | A * | 12/1965 | Denton | A42B 3/285 128/201.24 |
| 3,822,698 | A | 7/1974 | Guy | |
| 5,878,742 | A | 3/1999 | Figueredo et al. | |
| 5,898,935 | A | 5/1999 | Davis | |
| 6,173,447 | B1 | 1/2001 | Arnold | |
| 9,894,952 | B2 | 2/2018 | Hayes | |
| 10,278,442 | B2 | 5/2019 | Wang et al. | |
| 2007/0283482 | A1 | 12/2007 | Lawrence | |
| 2010/0125934 | A1* | 5/2010 | Green | A42B 3/225 2/424 |
| 2015/0143613 | A1* | 5/2015 | Chu | A42B 1/0182 2/171.3 |
| 2015/0335093 | A1 | 11/2015 | Curci et al. | |
| 2018/0242679 | A1* | 8/2018 | Johnstone | A42B 3/288 |
| 2021/0298381 | A1* | 9/2021 | Yeaman | A41D 13/1161 |
| 2021/0307427 | A1* | 10/2021 | Rybak | A41D 13/1184 |
| 2021/0315291 | A1* | 10/2021 | Votolato | A42B 1/245 |

* cited by examiner

*Primary Examiner* — Rachel T Sippel
(74) *Attorney, Agent, or Firm* — Eugene Vamos

(57) ABSTRACT

The PAPR frame is a low cost solution that allows the assembly of a PAPR device from readily available off-the-shelf elements. To assemble the PAPR device, a face shield is inserted into the PAPR frame. To utilize the PAPR device, a user inserts the visor of a hat into the PAPR frame and wears the hat. The PAPR device may further include tubing segments; the tubing segments are inserted into tubing apertures arranged through a top curved piece of the PAPR frame. The PAPR device may also further include one or two sound attenuation structures, which are used to dampen the potential noise generated by the air flow within the PAPR device.

20 Claims, 18 Drawing Sheets

PAPR FRAME

CROSS-REFERENCE TO RELATED APPLICATIONS

The present application claims benefit to U.S. provisional application Ser. No. 63/150,180 filed on Feb. 27, 2021

STATEMENT REGARDING FEDERALLY SPONSORED RESEARCH/DEVELOPMENT

Not Applicable

THE NAMES OF THE PARTIES TO A JOINT RESEARCH AGREEMENT

Not Applicable

REFERENCE TO A "SEQUENCE LISTING," A TABLE, OR A COMPUTER PROGRAM

Not Applicable

STATEMENT REGARDING PRIOR DISCLOSURES BY AN INVENTOR OR JOINT INVENTOR

PAPR:AzDA/ADA lifetime member dentist Dr. Don Acomb, Tucson, develops a positive air pressure respirator, Inscriptions, Arizona Dental Association, August 2020, p. 10, 12.

BACKGROUND OF THE INVENTION

1 Field of Invention

The PAPR Frame (100) relates generally to respirators that deliver an air supply to a PAPR user's protected breathing space to protect the PAPR user from aerosolized environmental risks.

2 Description of Related Art

A PAPR (Powered Air-Purifying Respirator) is an air-purifying respirator that uses a blower to provide air through filter cartridges or canisters into a PAPR user's protected breathing space (96). This process allows an air supply inside either a tight-fitting face-piece or loose-fitting head-gear providing a higher assigned protection factor (APF) than a reusable elastomeric non-powered air-purifying half face-piece (half mask) or N95 filter face-piece respirator (FFR). A PAPR can be used for protection during healthcare procedures in which health care providers are exposed to risks of aerosolized pathogens that cause acute respiratory infections. PAPRs are sometimes called positive-pressure masks, blower units, or just blowers.

3 Problems not Addressed by the Prior Art

Issue #1: Existing PAPR designs are time consuming to clean, normally 30 minutes or more, and involve multiple cleaning steps. PAPR cleaning requires training to accomplish adequate results. Because PAPR designs involve numerous components, including mechanical elements, maintaining PAPRs is non-trivial and requires a significant level of expertise and training. There is a need for a PAPR design that is easy to clean and maintain.

Issue #2: Existing PAPR designs narrow the PAPR user's field of vision, limiting the upward, downward, and peripheral range of vision. There is a need for a PAPR design that does not limit the PAPR user's range of vision.

Issue #3: Existing PAPR designs rely on a battery operated blower to provide air to the PAPR user. The battery life of current PAPR designs is limited and the PAPR batteries need to be recharged after approximately four hours of operation. This recharging requires that the PAPR be taken out of service or that batteries be exchanged, increasing sourcing, inventory, and charging issues. There is a need to eliminate these charging requirements.

Issue #4: Existing PAPR designs require air filters that need periodic replacement and that have adequate micron size filtration since the PAPR is in the same air environment as the aerosolized pathogens the PAPR user is guarding against. The periodic replacement of air filters create sourcing and inventory issues that add complexity to PAPR maintenance. There is a need to eliminate the need for air filters and the periodic replacement of air filters.

Issue #5: Existing PAPR designs are fragile and need total replacement if the PAPR is damaged. There is a need for a robust PAPR design that minimizes replacement costs if the PAPR is damaged.

Issue #6: Existing PAPR designs are cumbersome and weigh heavily on the PAPR user's head. There is a need for a light weight and comfortable design to be worn by the PAPR user.

Issue #7: Existing PAPR designs tend to enclose the head area and cause a sense of claustrophobia in some users. There is a need for a PAPR design that provides for a sense of openness.

Issue #8: Existing PAPR designs are tedious and labor intensive to properly apply and wear. There is a need for a PAPR design that is simple to don and wear.

Issue #9: Existing PAPR designs allow limited space for the PAPR user to wear glasses or other large volume head pieces such as headlamps and magnifying equipment. There is a need of a PAPR design that expands the space for the PAPR user to wear larger volume equipment.

DEFINITIONS transparent—allowing light to pass through so that objects behind can be seen.

projection—something that extends outward from a surface.

BRIEF SUMMARY OF THE INVENTION

The PAPR Frame (100) is a low cost solution that allows the assembly of a PAPR Device (102) from readily available off-the-shelf elements. To assemble the PAPR Device (102), a face shield (90) is inserted into the PAPR Frame (100). To utilize the PAPR Device (102), a PAPR user inserts a visor (82) of a hat (80) into the PAPR Frame (100) and wears the hat (80). The PAPR Device (102) may further comprise tubing segments (300); the tubing segments (300) are inserted into tubing apertures (164) arranged through a top curved piece (110) of the PAPR Frame (100). The PAPR Device (102) may further comprise an air source (320); the tubing segments (300) connect to the air source (320) providing an air supply into the protected breathing space (96) that is formed by the PAPR Frame (100), the face shield (90) and the visor (82) when worn by the PAPR user. The PAPR Device (102) may further comprise an air supply regulator (310) and tubing connectors (340); the air supply regulator (310) is placed between tubing segments (300). The tubing connectors (340) connect tubing segments (300) together. The air source (320) is preferably remote from the space where the PAPR user wearing the PAPR Device (102) is located.

DETAILED DESCRIPTION OF THE INVENTION

Figure 1:
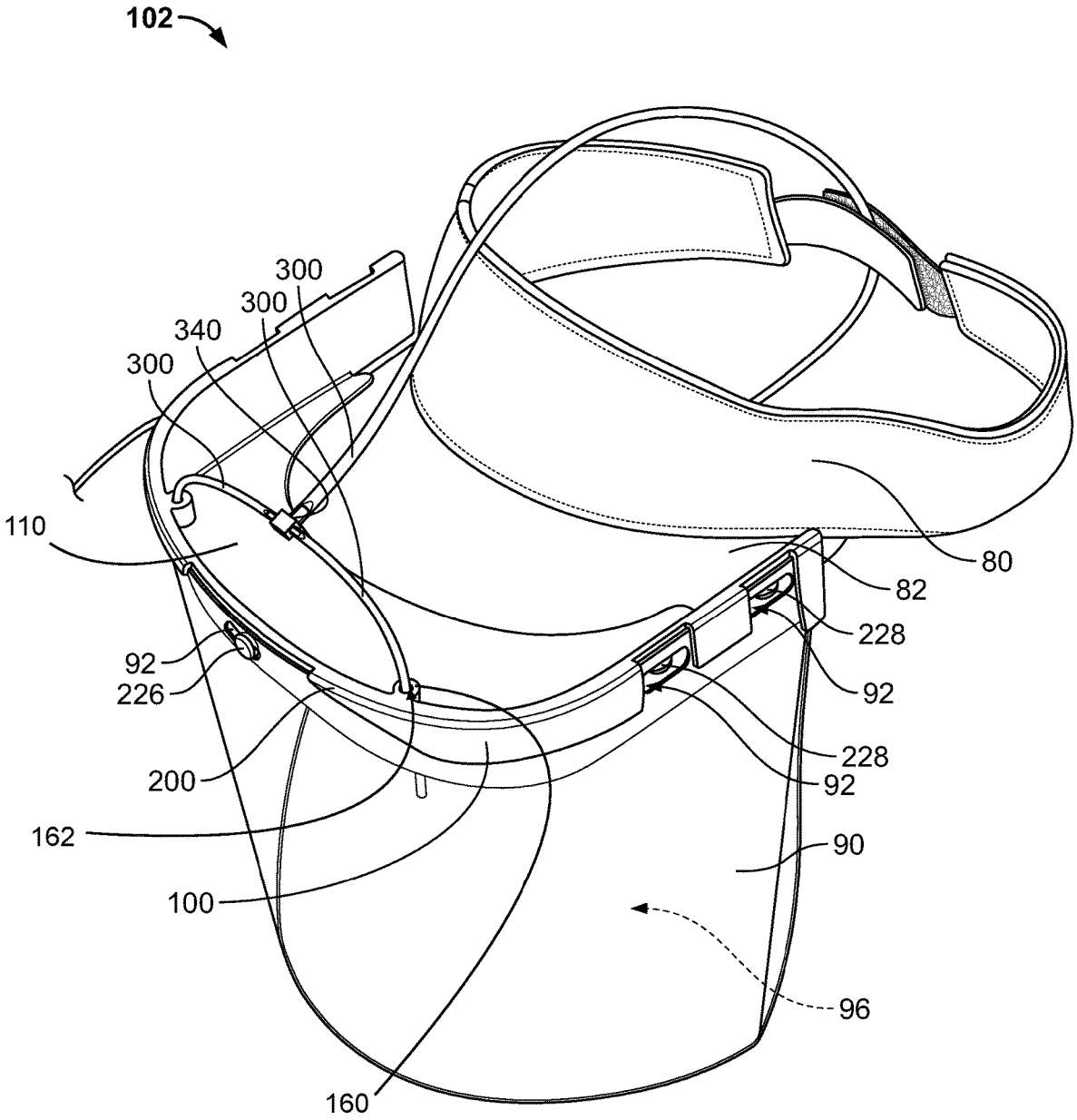
FIG. 1 shows a top left perspective view of the PAPR Frame (100), with the visor (82) of the hat (80) and the face shield (90) inserted into the PAPR Frame (100); the face shield holes (92) of the face shield (90) are fastened to a rivet (226) and two protrusions (228).

The PAPR Frame (100) is a low cost solution that allows the assembly of a PAPR Device (102) from readily available off-the-shelf elements. To assemble the PAPR Device (102), a face shield (90) is inserted into the PAPR Frame (100). To utilize the PAPR Device (102), a user inserts the visor (82) of a hat (80) into the PAPR Frame (100) and wears the hat (80). The PAPR Device (102) may further comprise tubing segments (300); the tubing segments (300) are inserted into tubing apertures (164) arranged through a top curved piece (110) of the PAPR Frame (100). The PAPR Device (102) may further comprise an air source (320); the tubing segments (300) connect to the air source (320) providing an air supply into the protected breathing space (96) that is formed by the PAPR Frame (100), the face shield (90) and the visor (82) when worn by the user. The PAPR Device (102) may further comprise an air supply regulator (310) and tubing connectors (340); the air supply regulator (310) is placed between tubing segments (300). The tubing connectors (340) connect tubing segments (300) together. The air source (320) is preferably remote from the space where the user wearing the PAPR Device (102) is located.

The PAPR Frame (100) and the PAPR Device (102) are suitable for environments where there are contact, droplet, airborne, and fomite modes of transmission of viruses, bacteria, and other harmful organisms and substances such as such as blood born splatter and aerosols with HIV, Hep C, Hep B, influenza, common cold, and COVID-19 ("harmful sources"). Medical and dental environments that seek to prevent such transmission are obvious deployment targets. The positive air pressure that is created within the protected breathing space also prevents smells from reaching the PAPR user. This is advantageous when the PAPR user is working near sources of foul smell including dentistry work. In a dental environment, the dentistry provider encounters daily patients with poor oral hygiene, periodontal disease, tongue coat, food impaction, unclean dentures, faulty restorations, oral carcinomas, throat infections, and necrosis.

1 PAPR Frame (100)

The PAPR Frame (100) comprises of a support structure (200), a top curved piece (110), a bottom curved piece (130) and a rim (170). The support structure (200), the top curved piece (110), the bottom curved piece (130), and the rim (170) are integrally joined.

The recurrent use of the PAPR Frame (100) and PAPR Device (102) necessitates regular cleaning. For the PAPR Frame (100) to be cleaned, the material choice of the PAPR Frame (100) needs to withstand the selected cleaning procedures, that is, disinfection, sanitation, or sterilization (ethylene oxide [EtO], irradiation [gamma/e-beam] and steam autoclaving). Suitable materials include metal and polymers such as thermoplastic and thermosetting polymers. For example, if autoclave sterilization is selected as the cleaning procedure, the PAPR Frame (100) material needs to withstand a high heat and high pressure environment. Examples of polymer materials that are compatible with autoclaving include Acetel, Nylon66, Noryl, and PBT.

1.1 Support Structure (200)

A support structure (200) comprises a back curved band (210) and a plurality of front curved band segments (220). The back curved band (210) comprises an inner surface (212) and an outer surface (214). The front curved band segments (220) comprise inner surfaces (222) and outer surfaces (224). The back curved band (210) is oriented parallel to the front curved band segments (220).

Figure 5:
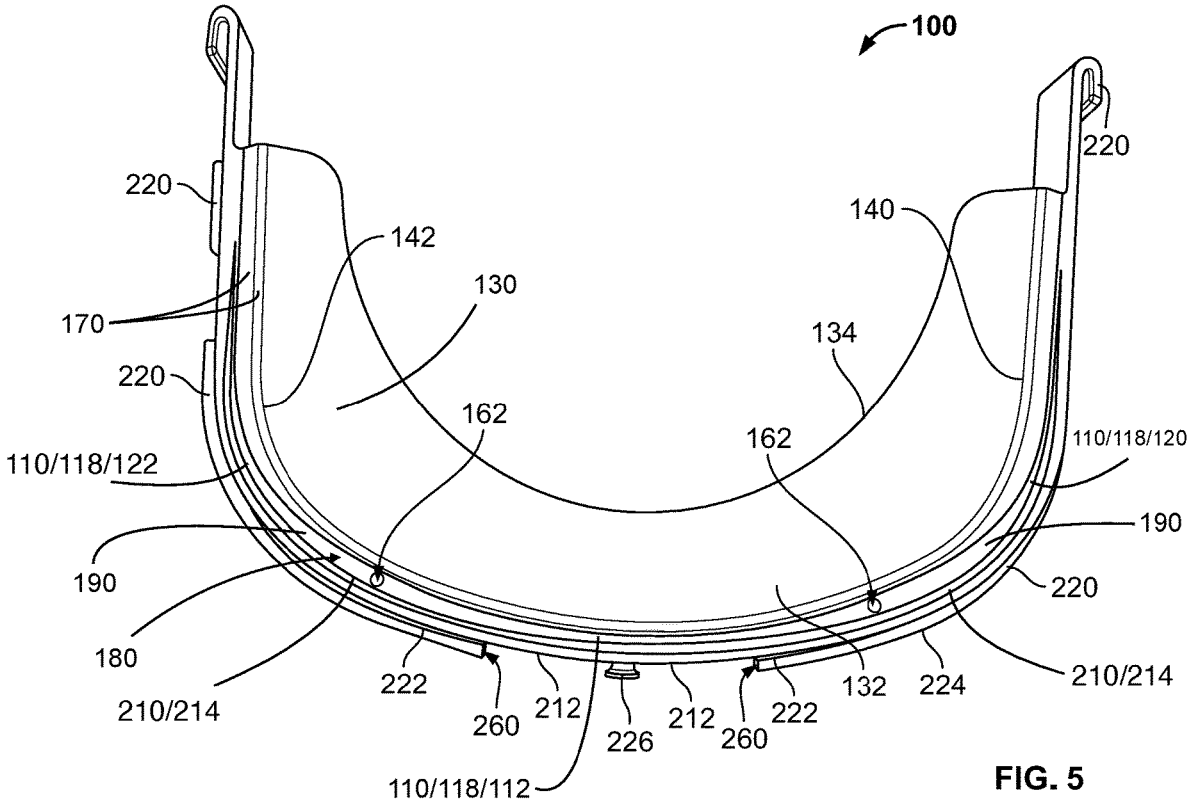
FIG. 5 shows a bottom view of the PAPR Frame (100), the bottom curved piece (130) and the top curved piece (110). The lower surface (118) of top curved piece (110) has two tubing apertures (164) that face the channel (180). The top curved piece (110) is joined to the outer surface (214) of the back curved band (210). The front edge (132), the right edge (140), and the left edge (142) of the bottom curved piece (130) are joined to the front edge (112), the right edge (120), and the left edge (122) of the top curved piece (110) by the rim (170).
Figure 6:
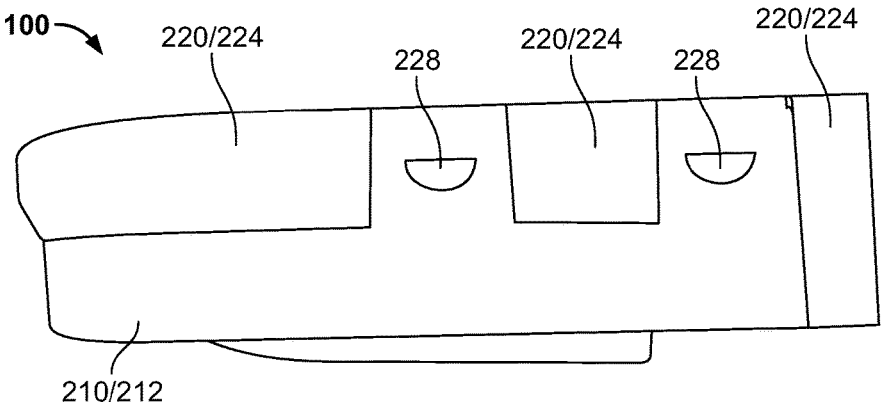
FIG. 6 shows a left view of the PAPR Frame (100).
Figure 7:
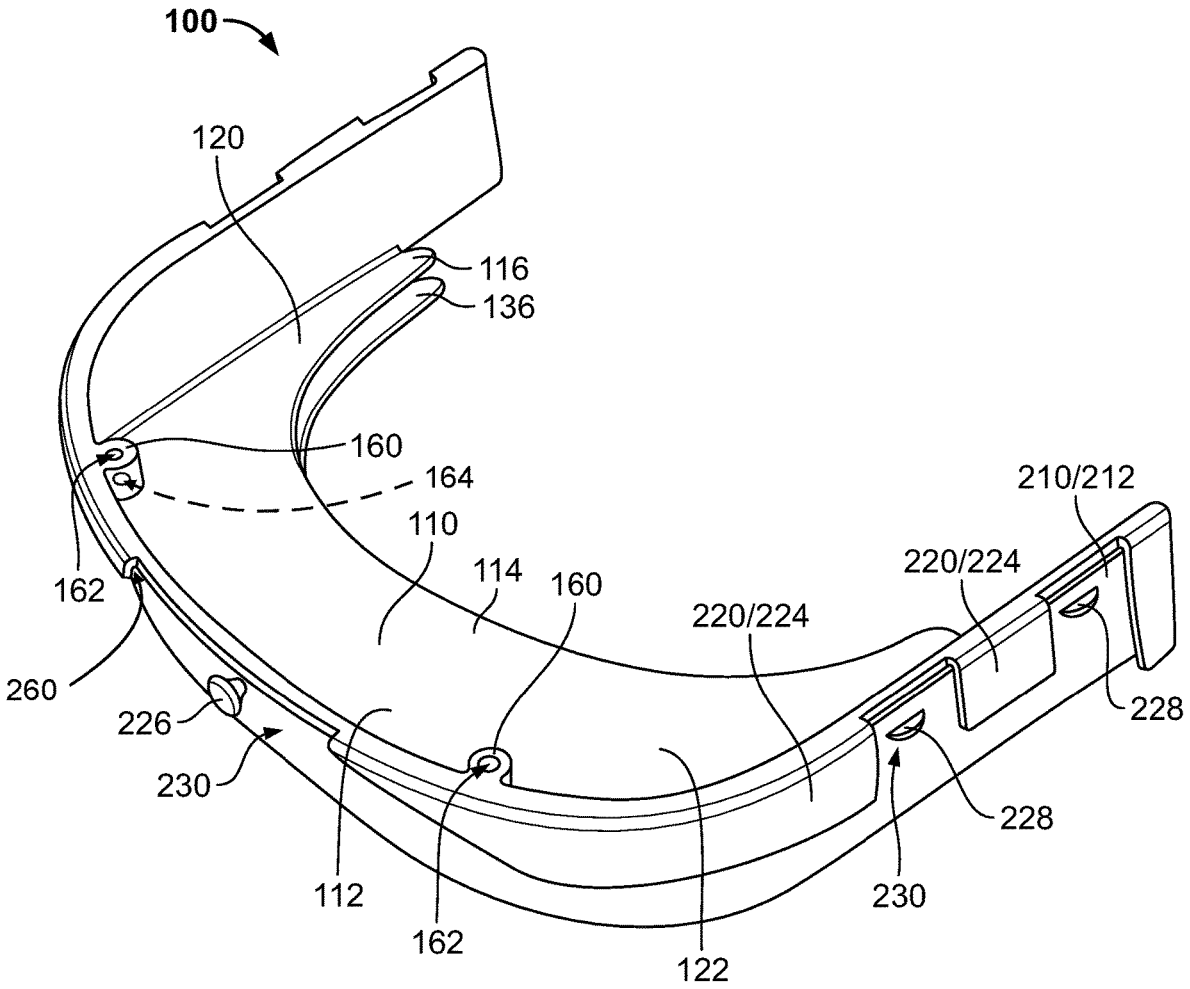
FIG. 7 shows a left top perspective view of the PAPR Frame (100) and the top curved piece (110), where two projections (160) are joined to the top curved piece (110) and the support structure (200).
Figure 8:
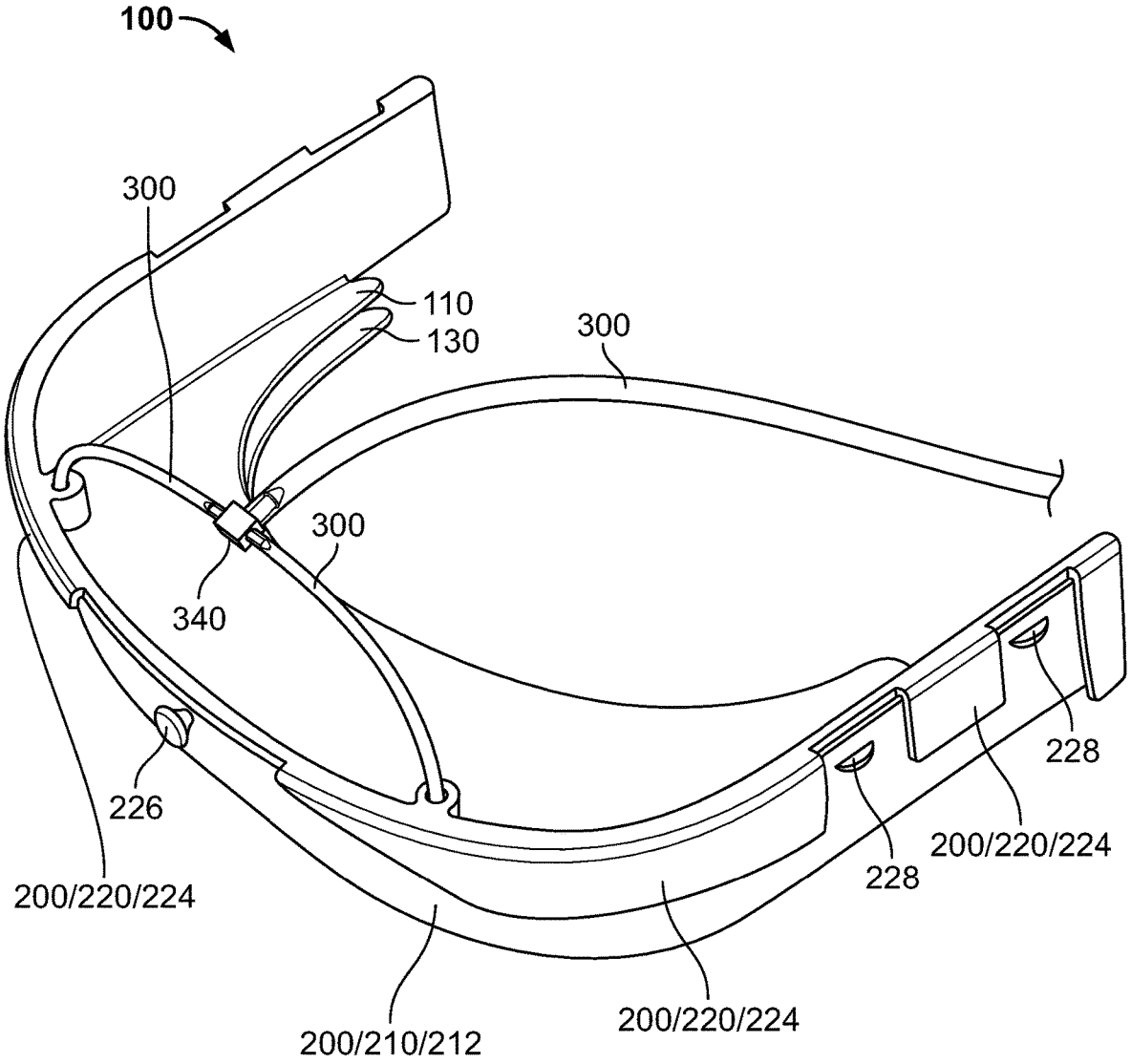
FIG. 8 shows a left top perspective view of the PAPR Frame (100) with the tubing segments (300) inserted into the tubing aperture (164).

The back curved band (210) is joined to the front curved band segments (220) forming a U-shape. The inner surface (212) of the back curved band (210) faces the inner surfaces (222) of the front curved band segments (220), forming a face shield receiving slot (260). FIG. 5 shows a bottom view of the PAPR Frame (100); the inner surface (212) of the back curved band (210) faces the inner surfaces (222) of the front curved band segments (220), forming a face shield receiving slot (260). FIG. 7 shows a left top perspective view of the PAPR Frame (100) where the back curved band (210) is joined to the front curved band segments (220), forming a U-shape and a face shield receiving slot (260).

A face shield (90) provides a physical separation between the PAPR user and the surrounding environment. An upper portion (94) of the face shield (90) is inserted into the face shield receiving slot (260) and is inserted between the inner surfaces (222) of the front curved band segments (220) and the inner surface (212) of the back curved band (210). The face shield (90) is a transparent piece of bendable material, preferably plastic. Because the face shield (90) can be detached from the face shield receiving slot (260), the face shield (90) can be disposed off and replaced with either a new face shield (90) or a recycled cleaned face shield (90).

To allow for face shield (90) cleaning, the material choice of the face shield (90) needs to withstand the selected cleaning procedures, that is, disinfection, sanitation, or sterilization (ethylene oxide [EtO], irradiation [gamma/e-beam] and steam autoclaving).

The face shield (90) comprises face shield holes (92), which are arranged through the upper portion (94) of the face shield (90). The face shield holes (92) are fastened to the protrusions (228) and rivets (226) of the support structure (200) of the PAPR Frame (100), fastening the face shield (90) to the PAPR Frame (100). FIG. 1 shows a top left perspective view of the PAPR Frame (100), with the upper portion (94) of the face shield (90) inserted into the PAPR Frame (100), so the face shield (90) is fastened to the PAPR Frame (100).

The spacing between the front curved band segments (220) is called the access space (230). The access space (230) allows for access to the inner surface (212) of the back curved band (210). The inner surface (212) of the back curved band (210) comprises one or more rivets (226) and one or more protrusions (228). These one or more rivets (226) and one or more protrusions (228) are located within the access space (230) of the front curved band segments (220). These one or more rivets (226) and one or more protrusions (228) are joined to the inner surface (212) of the back curved band (210). FIG. 7 shows a left top perspective view of the PAPR Frame (100), where one rivet (226) and two protrusions (228) joined to the inner surface (212) of the back curved band (210) are located within the access space (230) of the front curved band segments (220).

Figure 2:
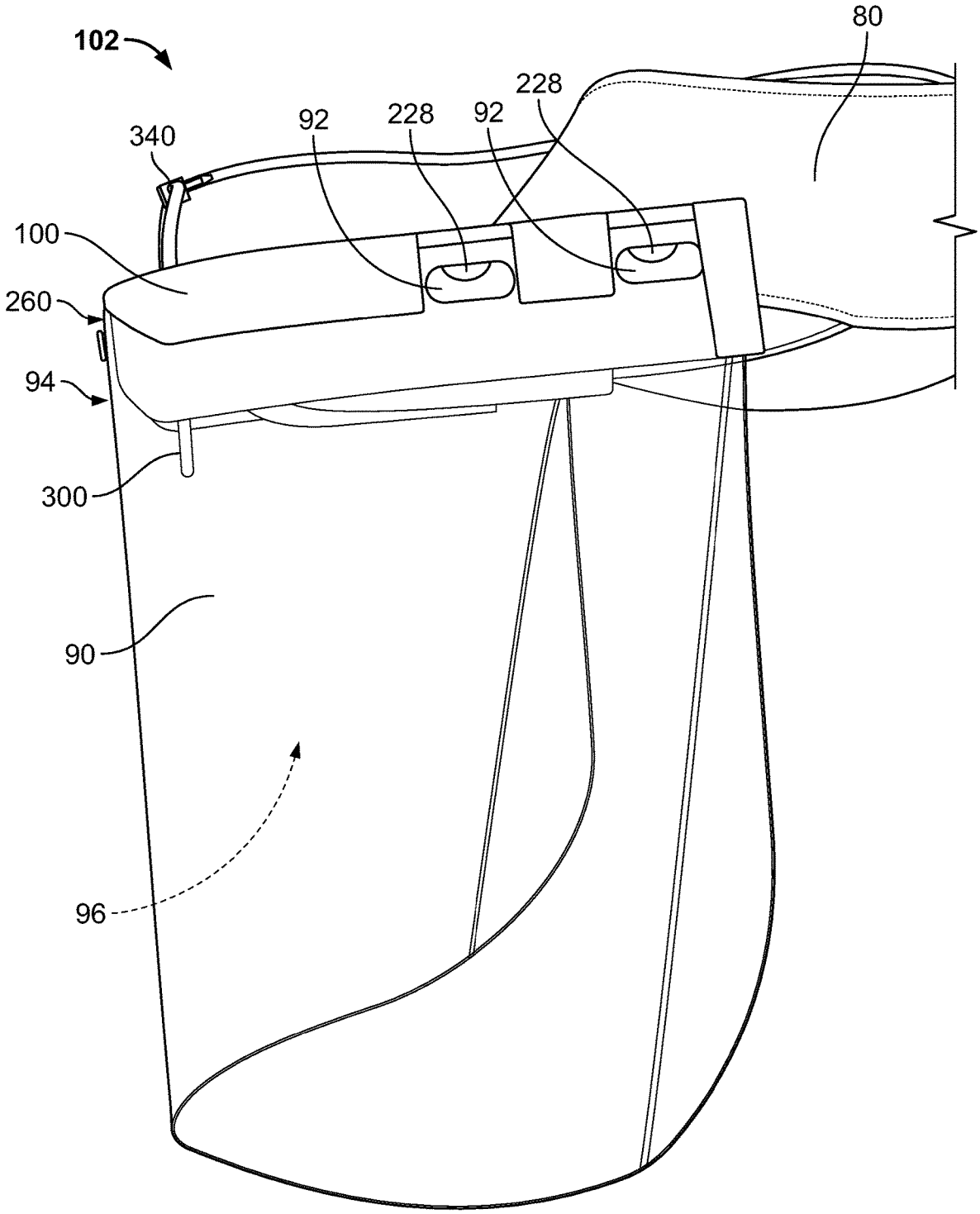
FIG. 2 shows a left side view of the PAPR Frame (100), with the visor (82) (not shown) of the hat (80) and the face shield (90) inserted into the PAPR Frame (100); the face shield holes (92) of the face shield (90) are fastened to two protrusions (228).

The face shield holes (92) arranged through the face shield (90) are fastened to the one or more rivets (226) and one or more protrusions (228) of the support structure (200) of the PAPR Frame (100). As an example, the inner surface (212) of the back curved band (210) may comprise one rivet (226) and two protrusions (228). FIG. 1 shows a top left perspective view of the PAPR Frame (100), with the face shield holes (92) of the face shield (90) fastened to a rivet (226) and two protrusions (228). FIG. 2 shows a left side view of the PAPR Frame (100) with the face shield holes (92) of the face shield (90) fastened to two protrusions (228).

Figure 3:
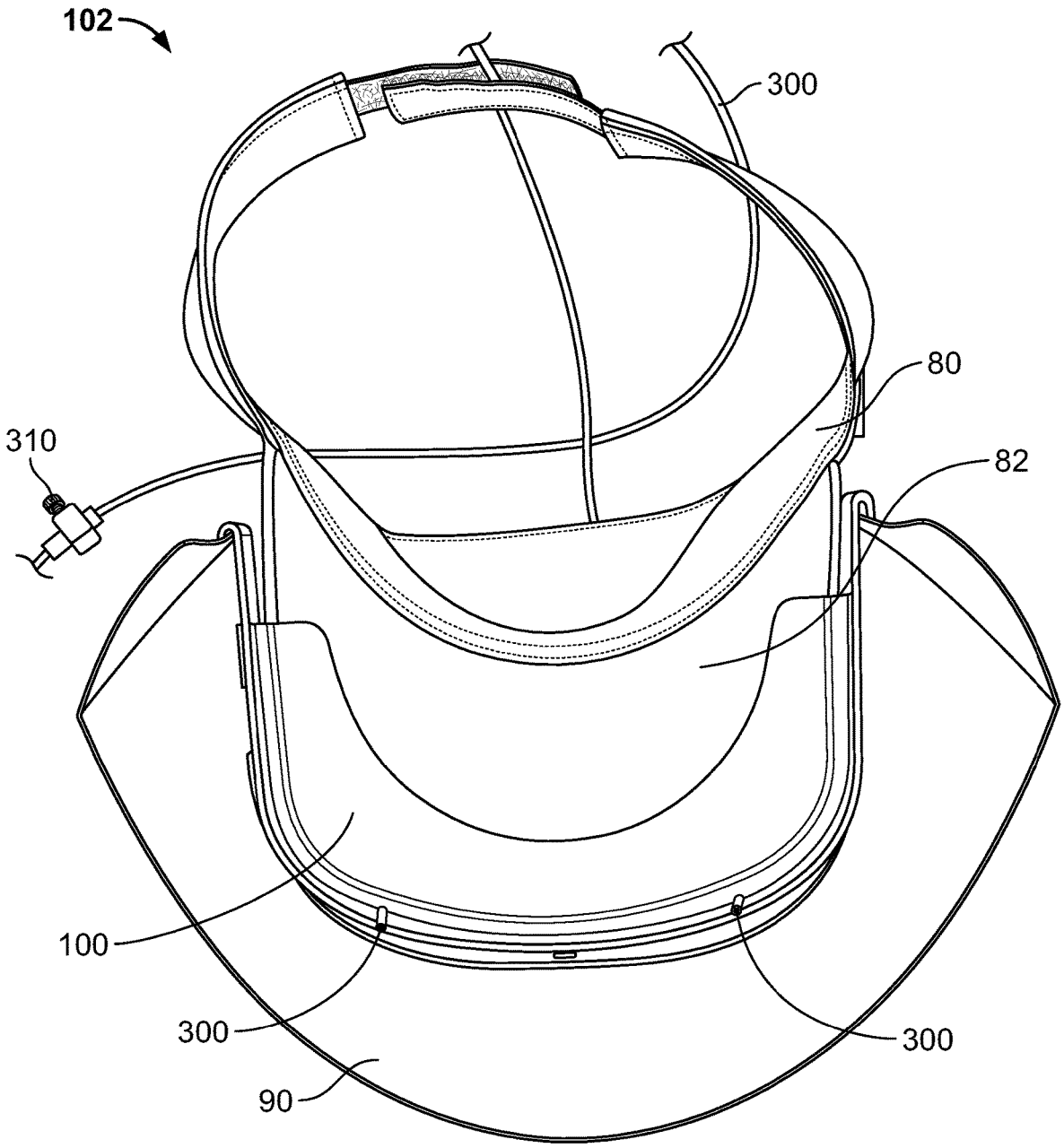
FIG. 3 shows a bottom view of the PAPR Frame (100), with the visor (82) of the hat (80) and the face shield (90) inserted into the PAPR Frame (100). Tubing segments (300) are connected to the air supply regulator (310). Tubing segments (300) are inserted through the tubing apertures (164) located on the lower surface (118) of the top curved piece (110).

The back curved band (210) and the front curved band segments (220) are so curved so that when the face shield (90) is inserted into the face shield receiving slot (260), the face shield (90) has a curved profile that allows for the face shield (90) to surround 180 degrees or more of the PAPR user's face and head. The face shield (90) allows for an enhanced range of vision for the PAPR user, as the face shield (90) does not block a PAPR user's peripheral vision. FIG. 3 shows face shield (90) inserted into the PAPR Frame (100), giving 180 degree protection to the PAPR user's face and head.

1.2 Top Curved Piece (110) & Bottom Curved Piece (130)

The top curved piece (110) and the bottom curved piece (130) allow the visor (82) of a hat (80) to be inserted into the PAPR Frame (100). The top curved piece (110) comprises a front edge (112), a back edge (114), a right edge (120), a left edge (122), an upper surface (116), and a lower surface (118). FIG. 7 shows a left top perspective view of the top curved piece (110) of the PAPR Frame (100). The bottom curved piece (130) comprises a front edge (132), a back edge (134), a right edge (140), a left edge (142), an upper surface (136), and a lower surface (138). FIG. 3 shows a bottom view of the PAPR Frame (100), the bottom curved piece (130), and the top curved piece (110).

Figure 4:
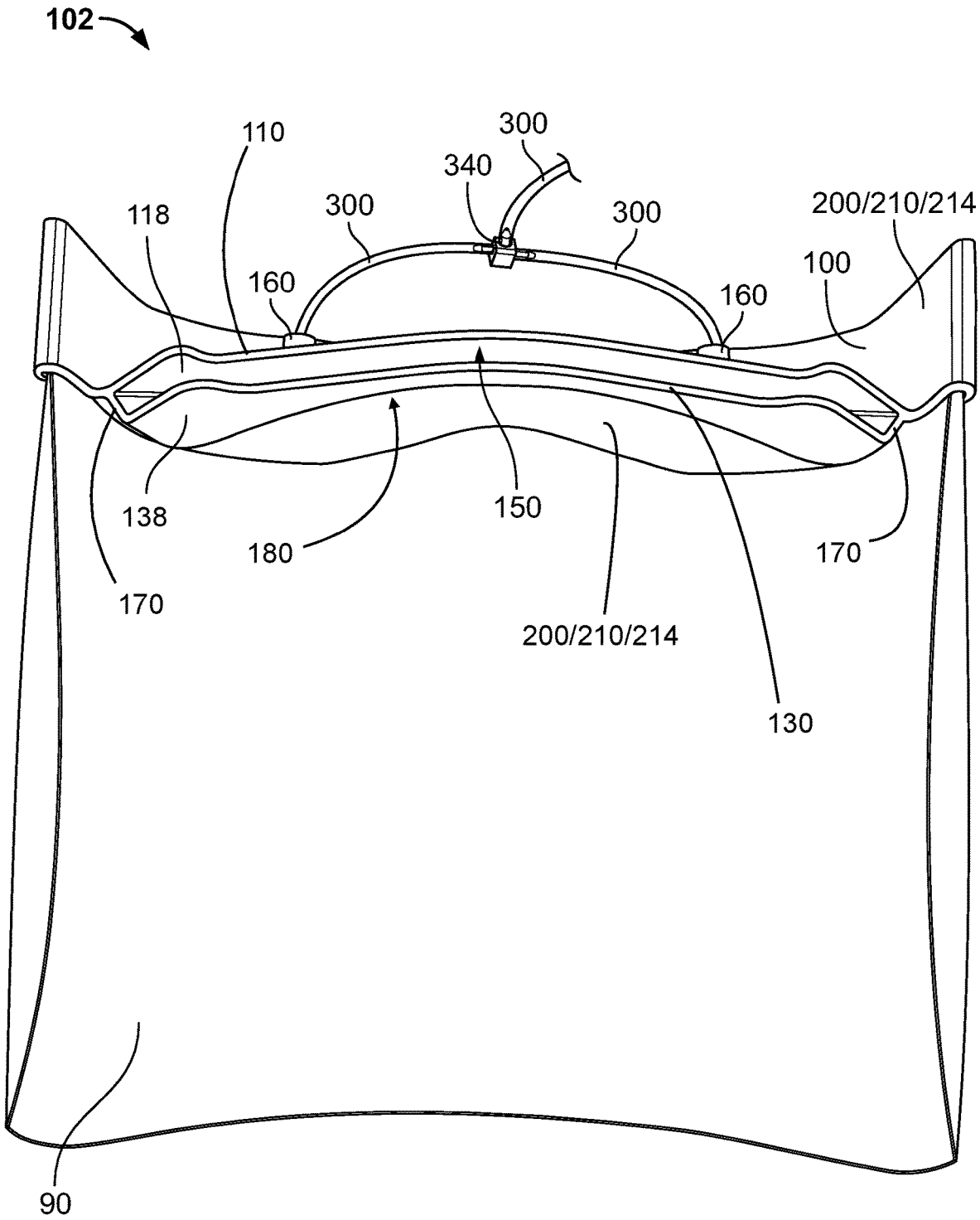
FIG. 4 shows a back view of the PAPR Frame (100), with the face shield (90) inserted into the PAPR Frame (100). A tubing connector (340) connects two tubing segments (300) that are inserted through the hollow (162) (not shown) of two projections (160).

The top curved piece (110) is joined to the support structure (200) and the bottom curved piece (130) is joined to the top curved piece (110) by a rim (170). FIG. 4 shows a back view of the PAPR Frame (100), where the top curved piece (110) is joined to the support structure (200), and the bottom curved piece (130) is jointed to the top curved piece (110) by a rim (170).

The front edge (112), the right edge (120), and the left edge (122) of the top curved piece (110) are joined to the outer surface (214) of the back curved band (210) of the support structure (200). The rim (170) joins the front edge (132), the right edge (140), and the left edge (142) of the bottom curved piece (130) to the front edge (112), the right edge (120), and the left edge (122) of the top curved piece (110) so that a channel (180) is created between the rim (170) and the outer surface (214) of the back curved band (210) of the support structure (200). The rim (170) is integrally joined to the top curved piece (110) and the bottom curved piece (130). The area of the top curved piece (110) that lies within the channel (180), that is, between the rim (170) and the outer surface (214) of the back curved band (210) of the support structure (200) is the tubing aperture receiving area (190).

FIG. 5 shows a bottom view of the PAPR Frame (100), the bottom curved piece (130) and the top curved piece (110). The lower surface (118) of top curved piece (110) has two tubing apertures (164) that face the channel (180). The tubing apertures (164) lie within the tubing aperture receiving area (190). The top curved piece (110) is joined to the outer surface (214) of the back curved band (210). The front edge (132), the right edge (140), and the left edge (142) of the bottom curved piece (130) are joined to the front edge (112), the right edge (120), and the left edge (122) of the top curved piece (110) by the rim (170).

Figure 9:
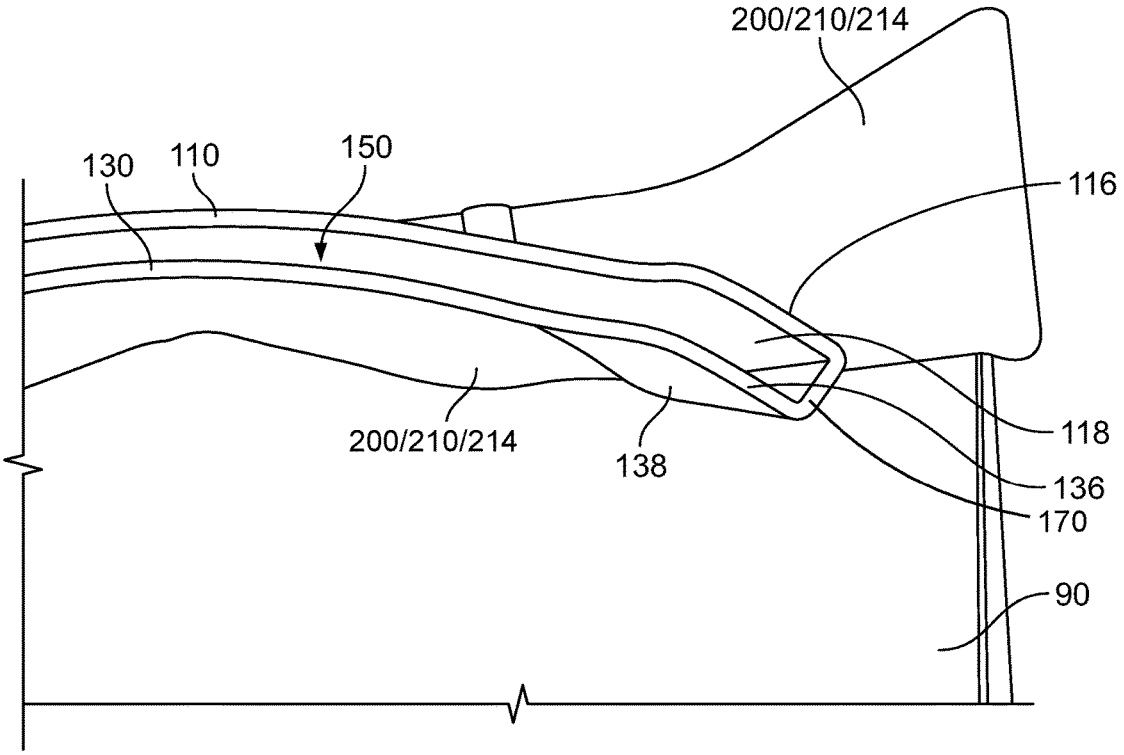
FIG. 9 shows a close-up back right view of the PAPR Frame (100), with the top curved piece (110) and the bottom curved piece (130) joined to the outer surface (214) of the back curved band (210) of the support structure (200).
Figure 10:
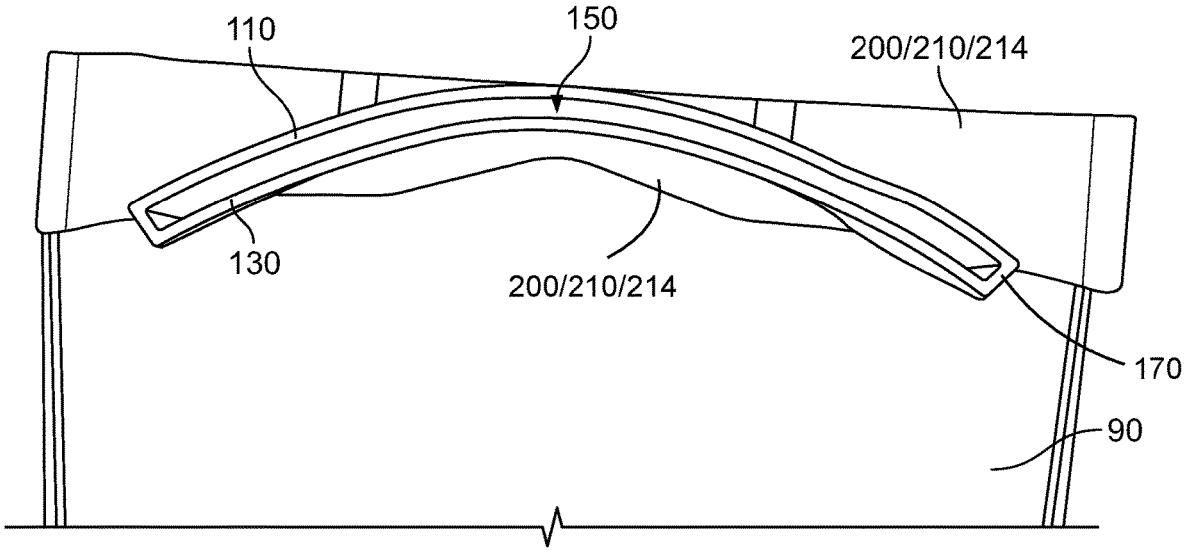
FIG. 10 shows a back view of the PAPR Frame (100), with the top curved piece (110), the bottom curved piece (130) and the rim (170) forming the visor receiving slot (150). The rim (170) joins the top curved piece (110) to the bottom curved piece (130).

The top curved piece (110) is oriented parallel to the bottom curved piece (130) with the lower surface (118) of the top curved piece (110) facing the upper surface (136) of the bottom curved piece (130). The top curved piece (110) and the bottom curved piece (130) along with the rim (170) form a visor receiving slot (150). The sizing of the rim (170) allows for precise dimensioning of the visor receiving slot (150) to control the fit between the visor (92) and the PAPR Frame (100). Because the visor thickness of various hat types might differ, the size of the rim (170) might change to accommodate various hat types. FIG. 10 shows a back view of the PAPR Frame (100), with the top curved piece (110), the bottom curved piece (130) and the rim (170) forming the visor receiving slot (150). FIG. 9 shows a close-up back right view of the PAPR Frame (100), with the top curved piece (110) joined to the outer surface (214) of the back curved band (210) of the support structure (200).

1.3 Tubing Apertures (164)

The top curved piece (110) comprises one or more tubing apertures (164) oriented between the upper surface (116) and the lower surface (118) of the top curved piece (110). The one or more tubing apertures (164) provide access for tubing segments (300) from outside of the PAPR Frame (100) into the protected breathing space (96) enclosed by the PAPR Frame (100), the face shield (90) and the hat (80). FIG. 5 shows a bottom view of the PAPR Frame (100), the top curved piece (110), and the bottom curved piece (130); the lower surface (118) of the top curved piece (110) has two tubing apertures (164). FIG. 3 shows a bottom view of the PAPR Frame (100), where tubing segments (300) are inserted through the tubing apertures (164) located on the lower surface (118) of the top curved piece (110).

The tubing segments (300) are inserted through the tubing apertures (164) on the upper surface (116) of the top curved piece (110), emerging from the lower surface (118) of the top curved piece (110) and face the channel (180) created between the rim (170) and the outer surface (214) of the back curved band (210) of the support structure (200). FIG. 1 shows a top left perspective view of the PAPR Frame (100), where tubing segments (300) are inserted through the upper surface of the top curved piece (110) into the protected breathing space (96) enclosed by the PAPR Frame (100), the face shield (90) and the visor (82) of the hat (80).

The spacing created by the channel (180) and the tubing aperture receiving area (190) is important for two reasons: a) the spacing guides the tubing segments (300) downwards and b) the spacing allows for tubing apertures (164) without compromising structurally the rim (170) and the back curved band (210) of the support structure (200).

The tubing segments (300) inserted through each tubing aperture (164) provide an air supply into the protected breathing space (96) enclosed by the PAPR Frame (100). To minimize the feeling of dry eye induced by the supply of air, the one or more tubing apertures (164) are located on the front edge (112) of the top curved piece (110) so that the one or more tubing apertures (164) are adjacent to the outer surface (214) of the back curved band (210) of the support structure (200).

The top curved piece (110) may further comprise one or more projections (160). Each tubing aperture (164) has a corresponding projection (160). The one or more projections (160) extend outward from the upper surface (116) of the top curved piece (110) and are joined to the upper surface (116) of the top curved piece (110). The one or more projections (160) may also be joined to the support structure (200) to provide additional structural support. Each projection (160) has a hollow (162), and the hollow (162) of each projection (160) is concentric to the corresponding tubing aperture (164). FIG. 7 shows a left top perspective view of the PAPR Frame (100) and the top curved piece (110), where two projections (160) are joined to the upper surface (116) of the top curved piece (110) and the support structure (200). The hollow (162) of each projection (160) is concentric to the corresponding tubing aperture (164).

The projection (160) forces the tubing segment (300) inserted into the hollow (162) and tubing aperture (164) to align substantially in the same axis as the axis of the hollow (162), allowing for more control of the orientation of the tubing segment (300). For example, if the hollow (162) is pointed perpendicular to the top curved piece (110), the hollow (162) points substantially straight down, forcing the tubing segments (300) to point straight down. This tubing segment control is very important because the comfort of the user wearing the PAPR Frame (100) dependents on how the air supply hits the face of the PAPR user within the protected breathing space (96). FIG. 1 shows a top left perspective view of the PAPR Frame (100), where tubing segments (300) are inserted through the hollows (162) of projections (160) and the tubing segments (300) point straight down in the protected breathing space (96) enclosed by the PAPR Frame (100), the face shield (90), and the hat (80).

2 Accessories

In order to bring full functionality to the PAPR Device (102), additional elements are needed. The PAPR Frame (100) may further comprise one or more tubing segments (300), an air supply regulator (310), an air source (320), an air filter (330) and tubing connectors (340). The addition of these elements allow the PAPR Frame (100) to function as a full feature PAPR.

Tubing segments (300) provide an air supply into the protected breathing space (96) enclosed by the PAPR Frame (100), the face shield (90) and the visor (82) of the hat (80). These tubing segments (300) are preferably of a flexible material that will allow for mobility for the PAPR user. Example flexible materials include silicone, PCV, polyurethane, fluoropolymers and thermoplastic elastomers. Tubing segments (300) are inserted through each tubing aperture (164) into the protected breathing space (96) enclosed by the PAPR Frame (100), the face shield (90) and the hat (80). If projections (160) are present, tubing segments (300) are inserted through the hollow (162) of each projection (160) and through each tubing aperture (164) into the protected breathing space (96) enclosed by the PAPR Frame (100), the face shield (90), and the visor (82) of the hat (80). FIG. 3 shows a bottom view of the PAPR Frame (100), with the visor (82) of the hat (80) inserted into the visor receiving slot (150) and the face shield (90) inserted into the face shield receiving slot (260). Tubing segments (300) are connected to the air supply regulator (310) and are inserted through the tubing aperture (164).

Tubing connectors (340) connect tubing segments (300) together to provide an air supply from the air source (320) into the protected breathing space (96) enclosed by the PAPR Frame (100), the face shield (90) and the hat (80). FIG. 4 shows a back view of the PAPR Frame (100), with the face shield (90) inserted into the face shield receiving slot (260). A tubing connector (340) connects two tubing segments (300), which are inserted through the hollows (162) (not shown) of two projections (160).

An air supply regulator (310) controls the flow of the air supply from the air source (320) to the PAPR Frame (100). The air supply regulator (310) connects tubing segments (300) together.

An air source (320) is a device that provides a motive force to an air supply. Examples of an air source (320) include an air pump or an air compressor. The air source (320) is used to provide an air supply through the tubing segments (300) into the protected breathing space (96) enclosed by the PAPR Frame (100), the face shield (90) and the visor (82) of the hat (80). The air source (320) is preferentially remote of where the PAPR user is located so the air source (320) can provide clean and dry air. An air filter (330) can be added to the air source (320) to filter the air supply of particulates to ensure a cleaner air supply. The air supply provided into the protected breathing space (96) creates a positive air pressure that prevents air from the surrounding environment from reaching the protected breathing space (96).

Figure 11:
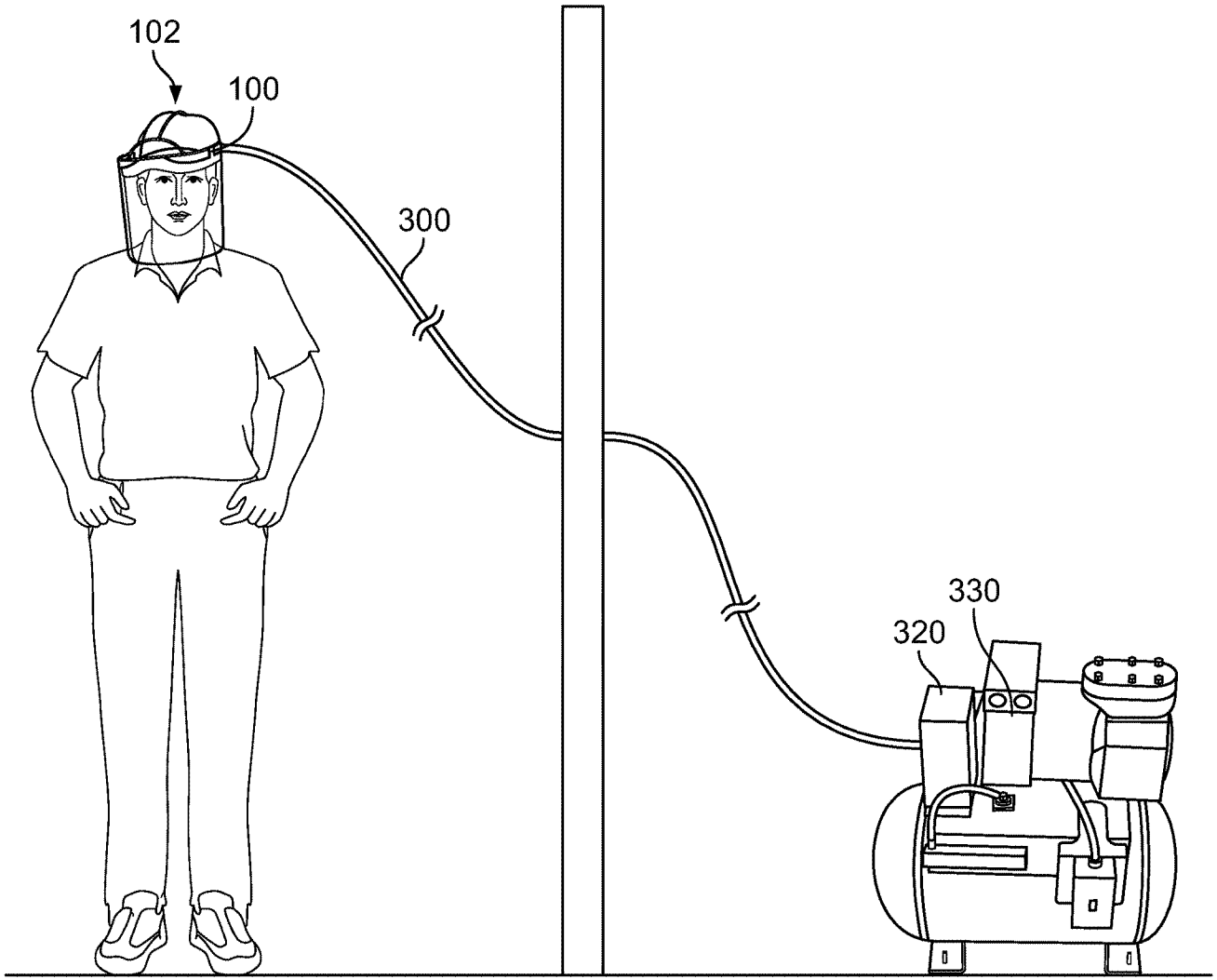
FIG. 11 shows a user wearing the PAPR Device (102) connected to the air source (320). The air source (320) has an air filter (330).

In some situations, the air source (320) sources a single PAPR Device (102). FIG. 11 shows a user wearing the PAPR Device (102) connected to the air source (320). The air source (320) has an air filter (330).

In other situations, the air source (320) allows for a centralized air source for multiple PAPR users at the same time. For instance, in a dental office, multiple dentists and dental assistants, each wearing a PAPR Device (102) in a different space can be connected to the centralized air source. This solution is also applicable where multiple PAPR users function in a single space such as warehousing activities, meat processing, hospital operating room activities. The tubing segments (300) would be organized such that they do not get in the way of these PAPR users.

3 Sound Attenuation Structure (400)

Figure 17:
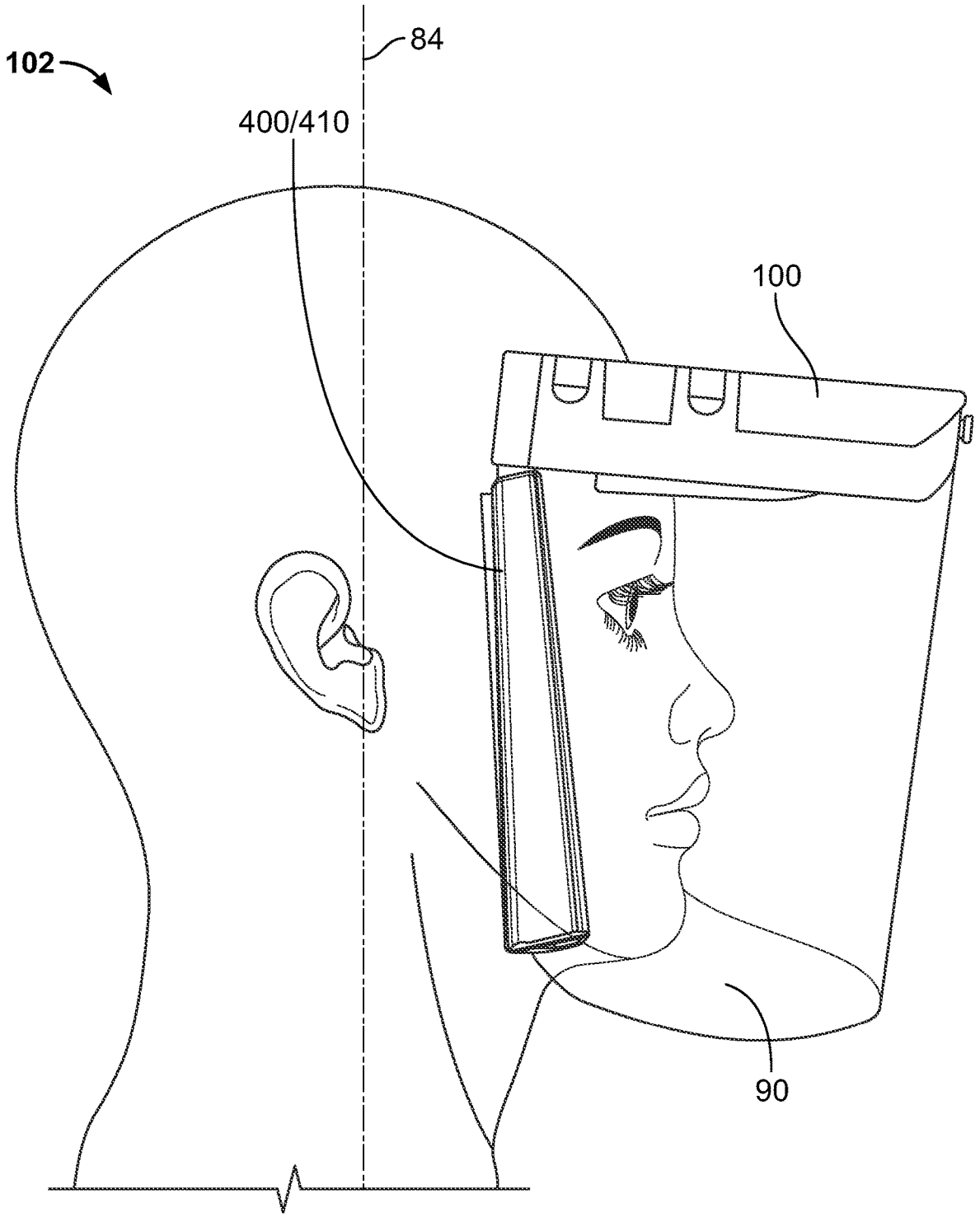
FIG. 17 is a right side view of a user wearing the PAPR Device (102) that has a right sound attenuation structure (410) fastened to the right edge (91) of the face shield (90).
Figure 18:
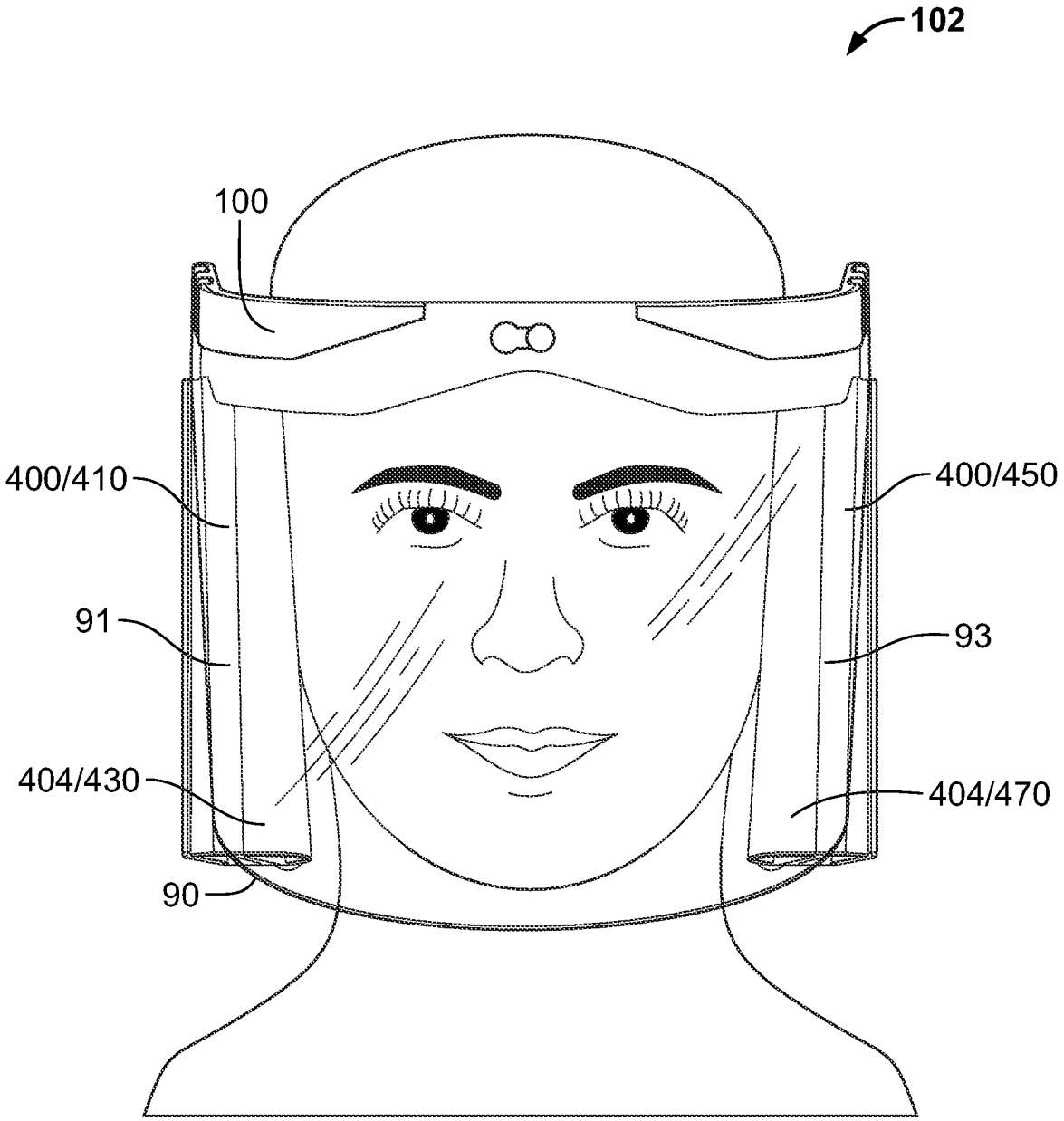
FIG. 18 is a front view of a user wearing a PAPR Device (102) that has a right sound attenuation structure (410) fastened to the right edge (91) of the face shield (90) and a left sound attenuation structure (450) fastened to the left edge (93) of the face shield (90).

The volume of the air supply flowing through the tubing segments (300) may generate noise, which may inconvenience the PAPR user. When added to the PAPR Device (102), a sound attenuation structure or silencer (400) dampens this noise, lowering its decibel level. The sound attenuation structure (400) fastens to the face shield (90). Once fastened to the face shield (90), the sound attenuation structure can be unfastened fro the face shield (90). The sound attenuation structure (400) comprises a clip (402) and a barrier (404). FIG. 17 shows a sound attenuation structure (400) fastened to the face shield (90). FIG. 18 shows two sound attenuation structures (400) fastened to the face shield (90).

The clip (402) fastens the sound attenuation structure (400) to the face shield (90). The barrier (404) dampens the noise generated by the volume of the air supply flowing through the tubing segments (300). The barrier (404) is joined to the clip (402).

To provide optimal sound dampening, the sound attenuation structure (400) extends height-wise from the bottom of the PAPR Frame (100) to some point below the chin of the PAPR user. The sound attenuation structure (400) can be manufactured in different heights to accommodate various head dimensions. A sound attenuation structure (400) height of around 4.5 inches accommodates a large segment of the population. FIG. 17 shows the barrier (404) of the sound attenuation structure (400) extending height-wise from the bottom of the PAPR Frame (100) to just below the chin of the PAPR user.

To provide optimal sound dampening, the barrier (404) extends width-wise from the clip (402) fastened to the face shield (90) to just before the face of the PAPR user (+/−1 cm). The sound attenuation structure (400) can be manufactured in different barrier (404) widths to accommodate various head dimensions. FIG. 18 shows the barrier (404) of the sound attenuation structure (400) extending width-wise from the clip (402) fastened to the face shield (90) to just before the face of the PAPR user (+/−1 cm).

The sound attenuation structure's (400) placement between the PAPR user's ears and the noise source and the sound attenuation structure's (400) dimensions (length-wise, width-wise, and height-wise) dampens the noise heard by the PAPR user, while allowing the PAPR user's ears to remain unburdened and unencumbered.

The sound attenuation structure (400) is preferably made of light weight (low density) materials that will not make the wearing of the PAPR Device (102) unwieldy. Suitable materials include but are not limited to thermoplastic (e.g. acrylics) and thermosetting polymers.

One embodiment of the sound attenuation structure (400) dampens the noise heard from the right ear of the PAPR user—the right sound attenuation structure (410). Another embodiment of the sound attenuation structure (400) dampens the noise heard from the left ear of the PAPR user—the left sound attenuation structure (450).

The right sound attenuation structure (410) fastens to the right edge (91) of the face shield (90); the left sound attenuation structure (450) fastens to the left edge (93) of the face shield (90). Depending on the sound attenuation requirements of the PAPR user, either the right sound attenuation structure (410), the left sound attenuation structure (450) or both are fastened to the face shield (90). In most instances, both the right sound attenuation structure (410) and the left sound attenuation structure (450) are utilized.

3.1 Right Sound Attenuation Structure (410)

Figure 12:
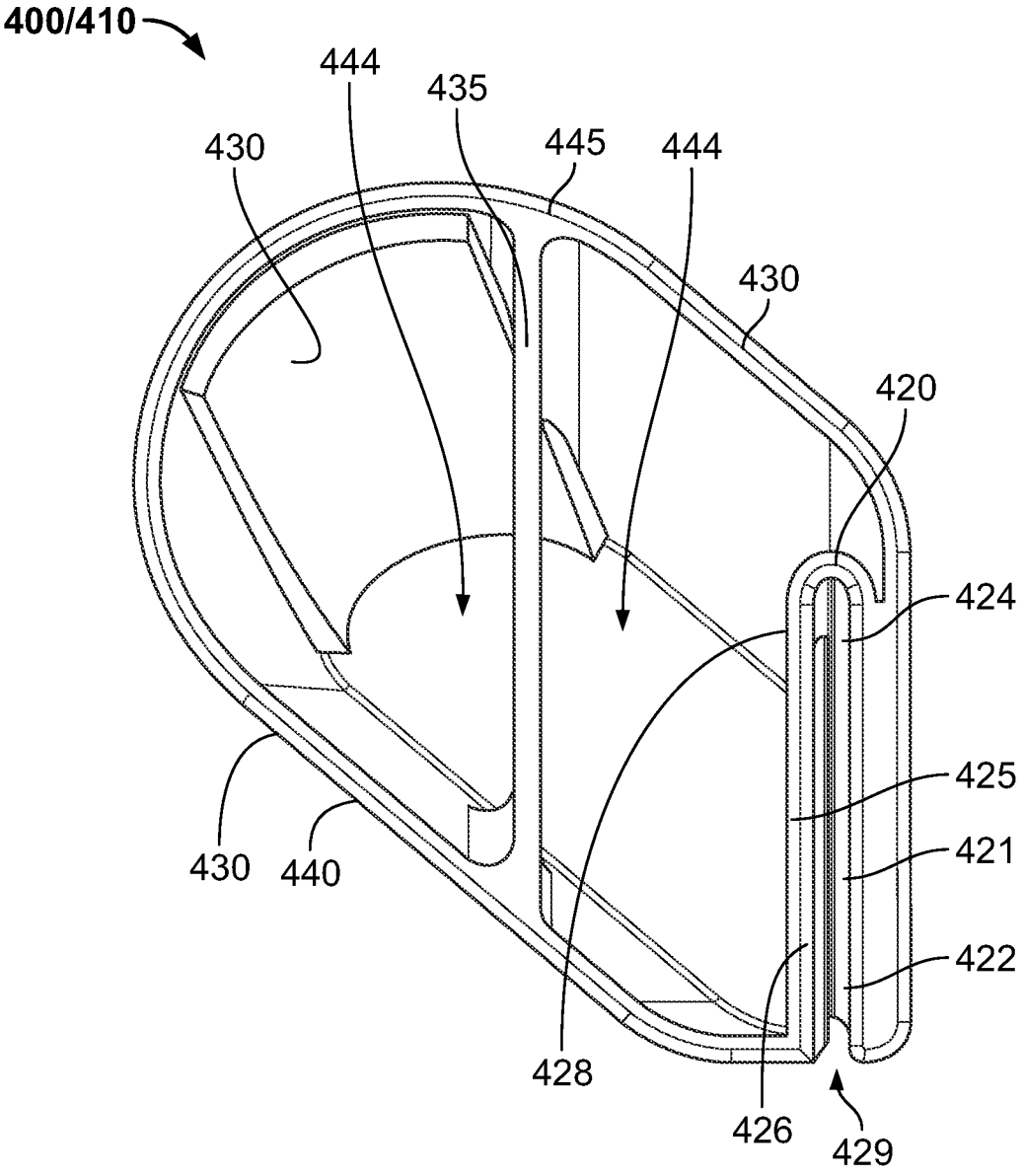
FIG. 12 is a bottom view of the right sound attenuation structure (410).

The right sound attenuation structure (410) comprises a clip (420) and a barrier (430). The clip (420) fastens the right sound attenuation structure (410) to the right edge (91) of the face shield (90). The barrier (430) is joined to the clip (420). The barrier (430) attenuates the noise generated by the volume of the air supply flowing through the tubing segments (300). FIG. 12 shows a bottom view of the right sound attenuation structure (410).

The clip (420) comprises a right leg (421) and a left leg (425). The right leg (421) comprises a front (422) and a back (424). The left leg (425) comprises a front (426) and a back (428). The back (424) of the right leg (421) is joined to the back (428) of the left leg (425) forming a slot (429). The right edge (91) of the face shield (90) is fastened to the slot (429). FIG. 12 shows the clip (420) comprising of a right leg (421) and a left leg (425).

Figure 14:
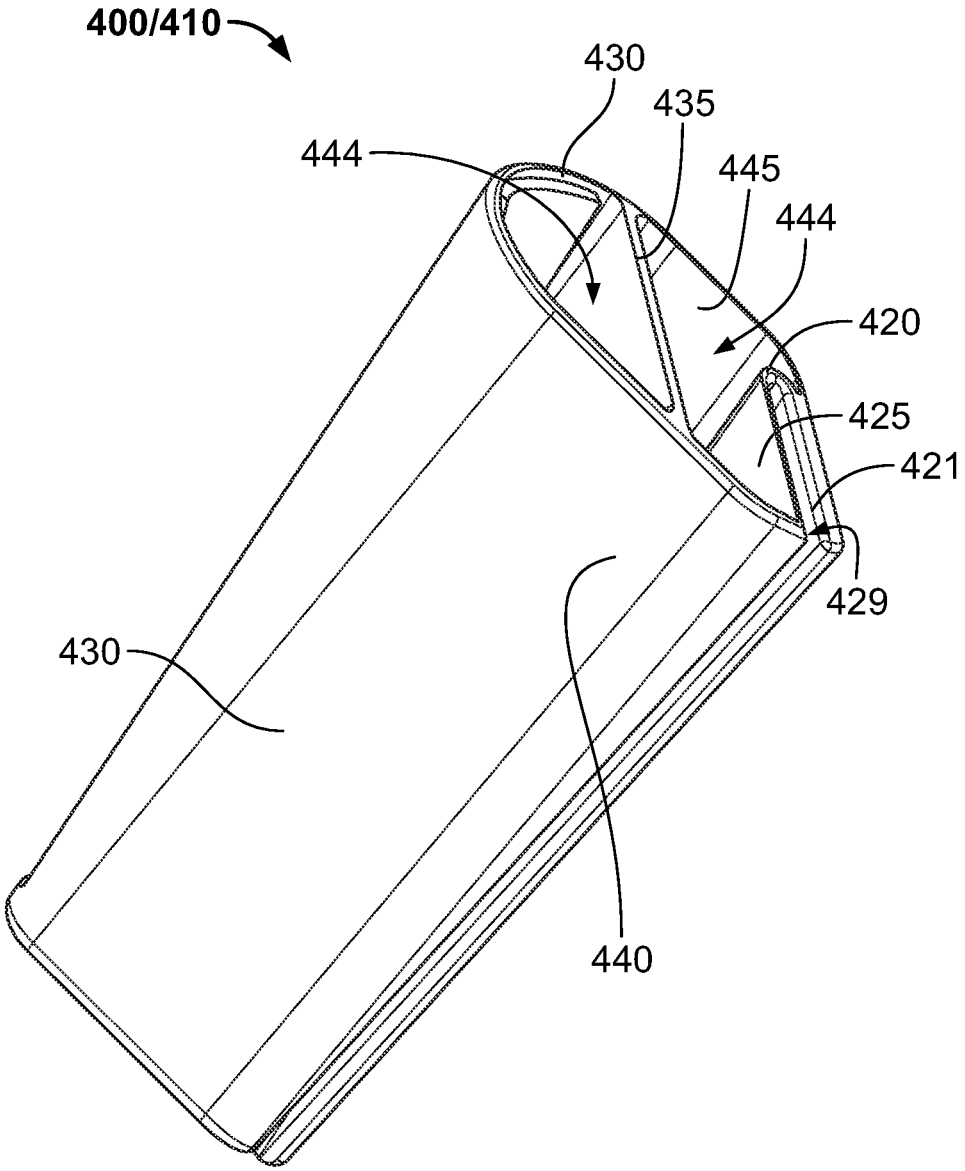
FIG. 14 is a perspective bottom view of the right sound attenuation structure (410).

The barrier (430) is joined to the clip (420) so that the barrier (430) abuts against the left leg (425) of the clip (420). FIG. 14 shows the right sound attenuation structure (410), where the barrier (430) abuts against the left leg (425) of the clip (420).

The right sound attenuation structure (410) may further comprise a plurality of support ridges (427). The plurality of support ridges (427) run length-wise on the right leg (421), the left leg (425) or both the right leg (421) and the left leg (425). The support ridges (427) partly occupy the volume of the slot (429). The support ridges (427) allow for an enhanced fastening between the clip (420) of the right sound attenuation structure (410) and the right edge (91) of the face shield (90). Without the use of these support ridges (427), the slot (429) needs to match the width of the right edge (91) of the face shield (90) within tight tolerances for the face shield (90) to remain fastened to the clip (420). If the slot (429) is too narrow, the right edge (91) of the face shield (90) can not be inserted in the slot (429). If the slot (429) is too wide, the right edge (91) of the face shield (90) will not remain fastened to the clip (420) and fall out. Because the thickness of face shields (90) varies from one manufacturer to the other, this would require customized sound attenuation structures (400) for each type of face shield (90) would be required.

Figure 16:
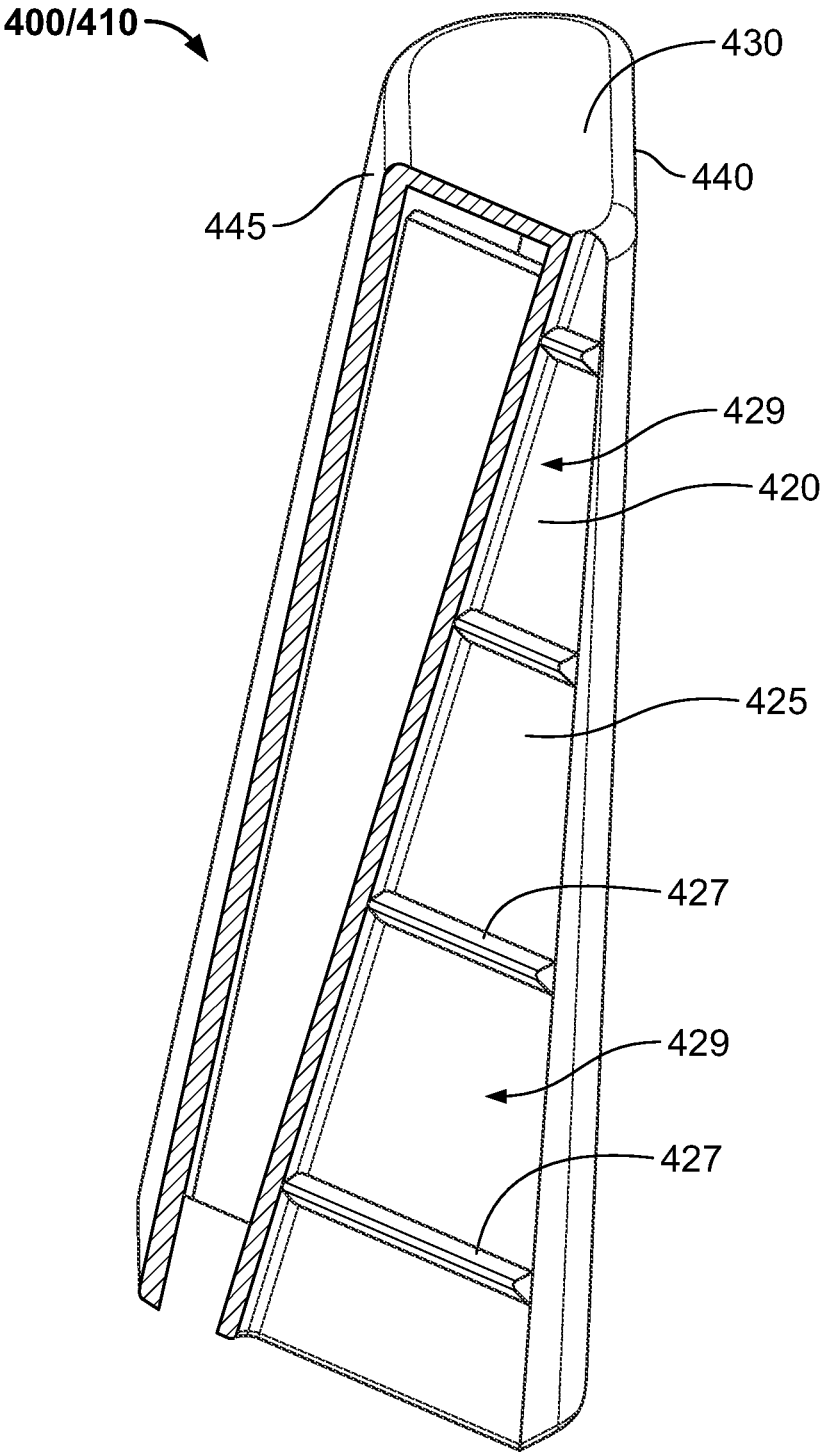
FIG. 16 is a cross sectional perspective top back view of the right sound attenuation structure (410).

The plurality of support ridges (427) enables a wider tolerance of face shield (90) widths to fit onto the clip (420) as the support ridges (427) allow: a) for easier sliding of the face shield (90) into the slot (429) and b) for bending of the face shield (90) as the face shield (90) is inserted into the slot (429). FIG. 16 is a cross sectional perspective top back view of the right sound attenuation structure (410) showing the plurality of support ridges (427) on the left leg (425) of the clip (460).

The slot (429) allows the right edge (91) of the face shield (90) to be fastened to the clip (420) of the right sound attenuation structure (410). The length-wise cross section of the slot (429) can be any shape that allows the right edge (91) of the face shield (90) to be fastened to the clip (420) of the right sound attenuation structure (410); for example, the length-wise cross section can be rectangular or triangular. FIG. 16 is a cross sectional perspective top back view of the right sound attenuation structure (410) showing a triangular length-wise cross section of the slot (429).

The cross-sectional shape of the slot (429) may complement the shape of right edge (91) of the face shield (90) so that the right sound attenuation structure (410) height-wise lies substantially parallel (+/−20 degrees) to the axial axis (84) of the PAPR user's head when inserted into the face shield (90). This allows for the right sound attenuation structure (410) to provide optimal sound attenuation. For example, a right sound attenuation structure (410) with a triangular length-wise cross section would complement a triangular right edge (91) of the face shield (90). FIG. 17 shows the right sound attenuation structure (410) height-wise lies substantially parallel (+/−20 degrees) to the axial axis (84) of the PAPR user's head.

The barrier (430) may have a solid composition.

Alternatively, the barrier (430) may have a hollow composition. When the barrier has a hollow composition, it comprises a front wall (440), a back wall (445), and one or more cavities (444). The front wall (440) and the back wall (445) may have a flat profile, a curved profile or a combination of flat and curved profiles. The front wall (440) and the back wall (445) are joined. The barrier (430) may further comprise one or more inner walls (435), which join the front wall (440) to the back wall (445) to provide structural support, creating a plurality of cavities (444). The one or more inner walls (435) are located within the barrier (430) FIG. 14 shows a perspective bottom view of the right sound attenuation structure (410) with two cavities (444), created by a inner wall (435).

Figure 19:
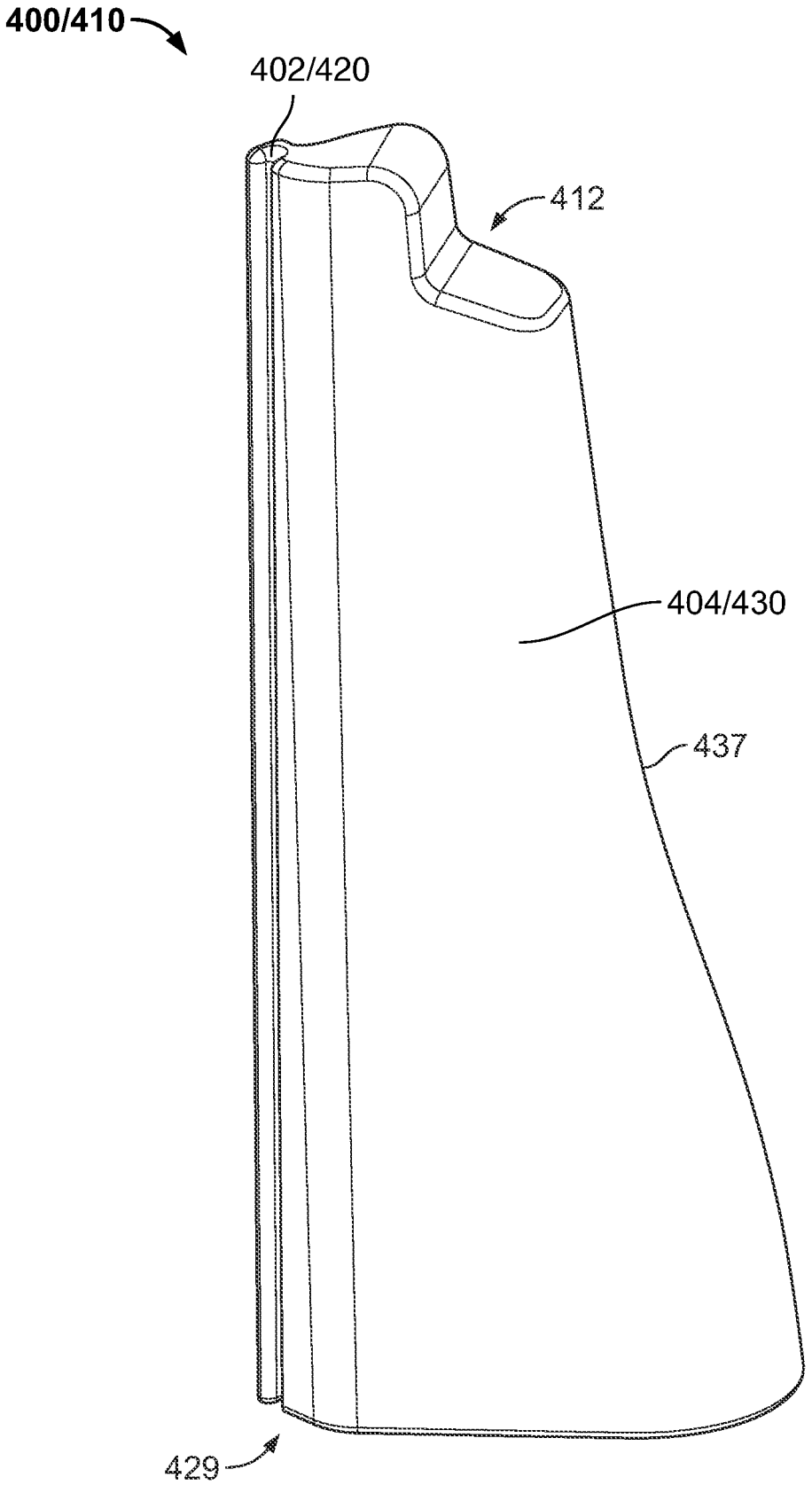
FIG. 19 is a front view of the right sound attenuation structure (410) with a right temple notch (412) on the upper end of the barrier (430)

The barrier (430) may further comprise a side wall (437). The side wall (437) joins the front wall (440) to the back wall (445). FIG. 19 is a front view of the right sound attenuation structure (410) where the barrier (430) has a side wall (437).

The barrier (430) may taper from the bottom end of the barrier (430) towards the top end of the barrier (430). This tapering follows the contour of a human face and allows for a close fit between the PAPR user's face and the barrier (430). This tapering minimizes the space between the PAPR user's face and the barrier (430) that transmits sound towards the right ear of the PAPR user. FIG. 19 is a front view of the right sound attenuation structure (410) with a barrier (430) tapering from the bottom end of the barrier (430) towards the upper end of the barrier (430).

Because of the close fit between the barrier (430) and the PAPR user's face, the barrier (430) makes difficult the usage of eyeglasses with the PAPR Frame (100). To allow the usage of eyeglasses, the barrier (430) may further comprise a right temple notch (412), located on the upper left corner of the barrier (430). The eyeglasses' right temple is placed through the right temple notch (412). FIG. 19 is a front view of the right sound attenuation structure (410) with a right temple notch (412) on the upper left corner of the barrier (430).

3.2 Left Sound Attenuation Structure (450)

Figure 13:
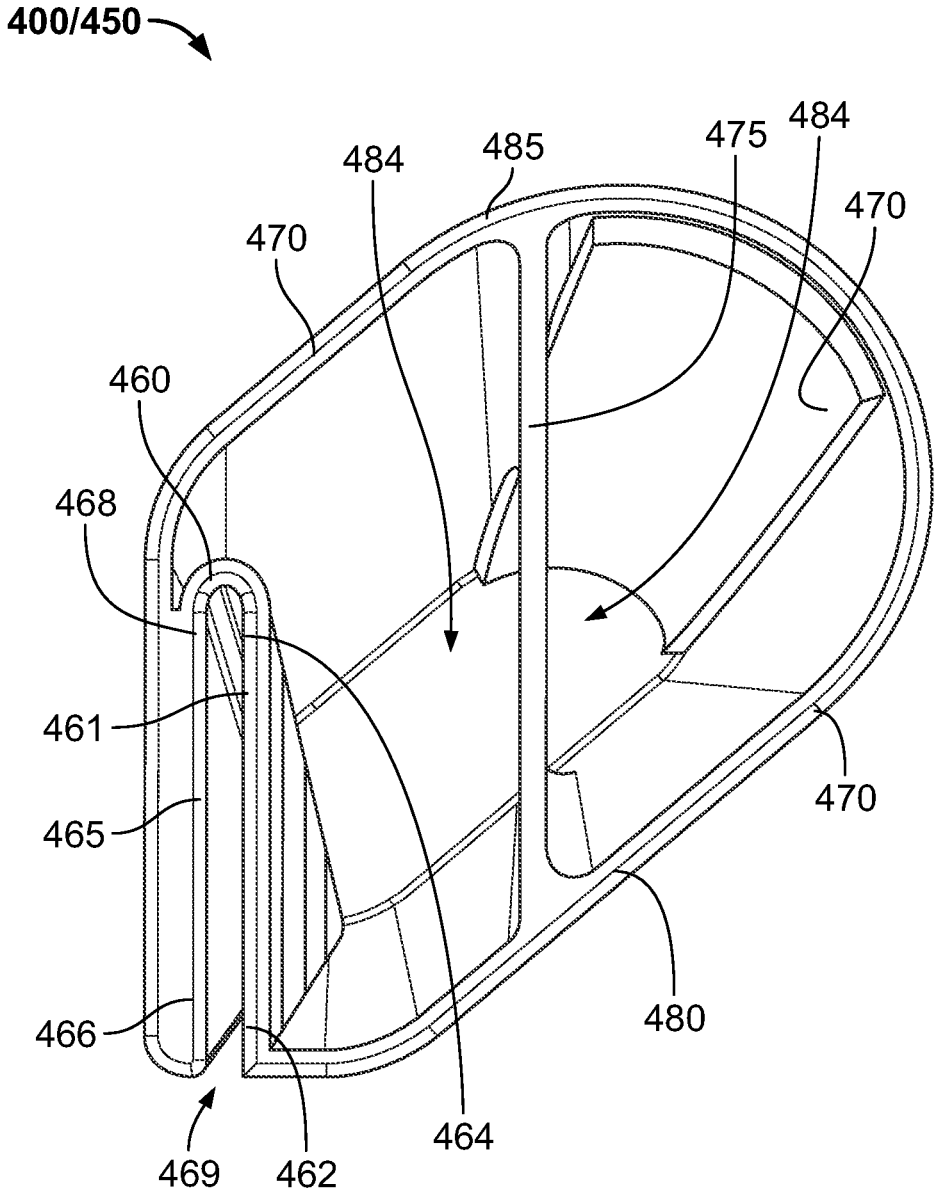
FIG. 13 is a bottom view of the left sound attenuation structure (450).

The left sound attenuation structure (450) comprises a clip (460) and a barrier (470). The clip (460) fastens the left attenuation structure (450) to the left edge (93) of the face shield (90). The barrier (470) is joined to the clip (460). The barrier (470) attenuates the noise generated by the volume of the air supply flowing through the tubing segments (300). FIG. 13 shows a bottom view of the left sound attenuation structure (450).

The clip (460) comprises a right leg (461) and a left leg (465). The right leg (461) comprises a front (462) and a back (464). The left leg (465) comprises a front (466) and a back (468). The back (464) of the right leg (461) is joined to the back (468) of the left leg (465) forming a slot (469). The left edge (93) of the face shield (90) is fastened to the face shield receiving slot (469). FIG. 13 shows the clip (460) comprising of a right leg (461) and a left leg (465).

The barrier (470) is joined to the clip (460) so that the barrier (470) abuts against the right leg (461) of the clip (460). FIG. 13 shows the left sound attenuation structure (450), where the barrier (470) abuts against the right leg (461) of the clip (460).

The left sound attenuation structure (450) may further comprise a plurality of support ridges (467). The plurality of support ridges (467) run length-wise on the right leg (461), the left leg (465) or both the right leg (461) and the left leg (465). These support ridges (467) partly occupy the volume of the slot (469). These support ridges (467) allow for an enhanced fastening between the clip (460) of the left sound attenuation structure (450) and the left edge (93) of the face shield (90). Without the use of these support ridges (467), the slot (429) needs to match the width of the right edge (91) of the face shield (90) within tight tolerances for the face shield (90) to remain fasted to the clip (460). If the slot (469) is too narrow, the left edge (93) of the face shield (90) can not be inserted in the slot (469). If the slot (469) is too wide, the left edge (93) of the face shield (90) will not fasten to the clip (460) and subsequently fall out. Because the thickness of face shields (90) varies from one manufacturer to the other, this would require customized sound attenuation structures (400) for each type of face shield (90) would be required.

Figure 15:
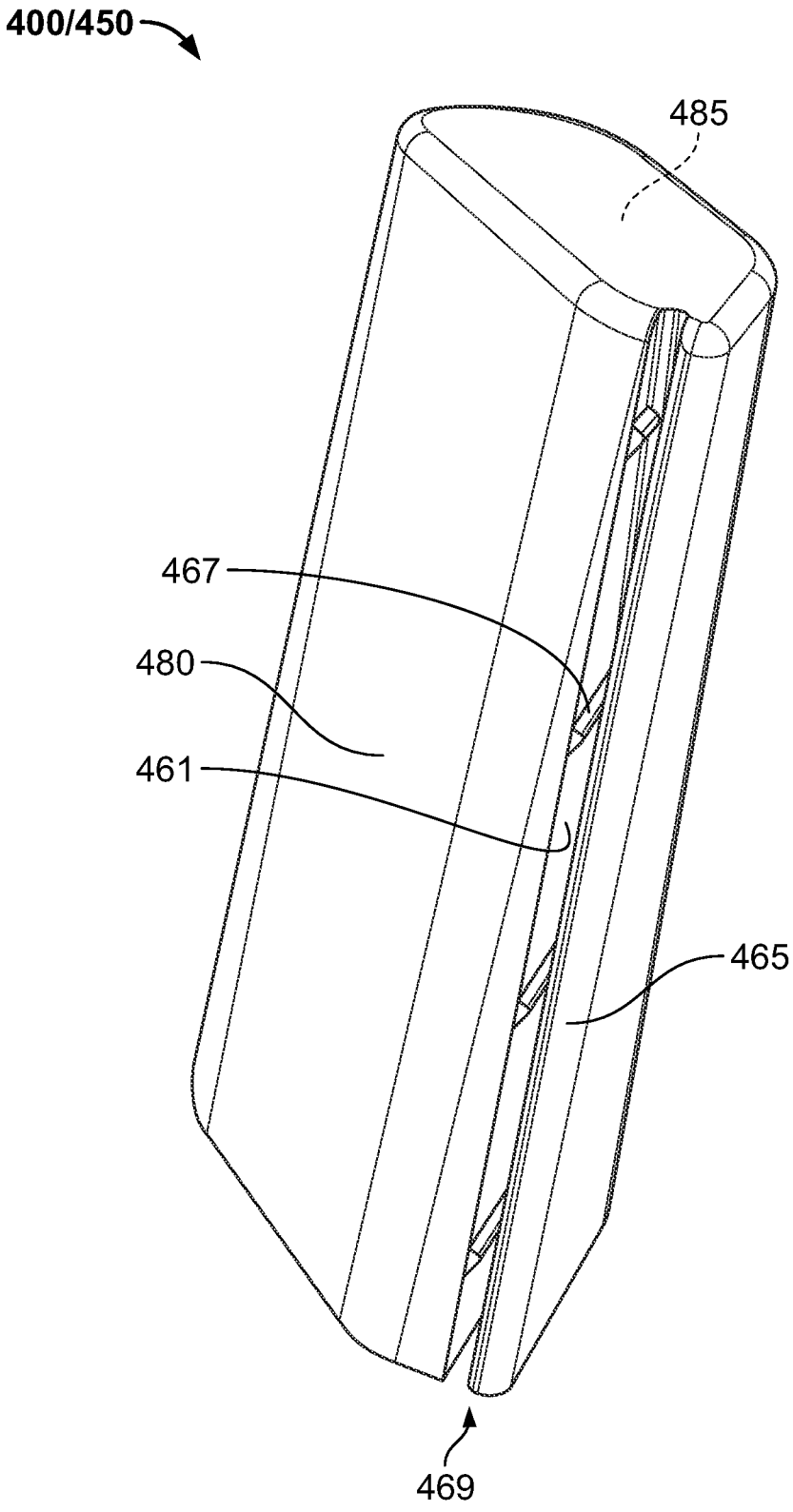
FIG. 15 is a perspective top view of the left sound attenuation structure (450).

The plurality of support ridges (467) enables a wider tolerance of face shield (90) widths to fit onto the clip (460) as the support ridges (467) allow: a) for easier sliding of the face shield (90) into the slot (469) and b) for bending of the face shield (90) as the face shield (90) is inserted into the slot (469). FIG. 15 is a perspective top view of the left sound attenuation structure (450) showing the plurality of support ridges (467) on the left leg (465) of the clip (460).

The slot (469) allows the left edge (93) of the face shield (90) to be fastened to the clip (460) of the left sound attenuation structure (450). The length-wise cross section of the slot (469) can be any shape that allows the left edge (93) of the face shield (90) to be fastened to the clip (460) of the left sound attenuation structure (450); for example, the length-wise cross section can be rectangular or triangular. FIG. 15 is a perspective top view of the left sound attenuation structure (450), showing a triangular length-wise cross section of the slot (469).

The cross-sectional shape of the slot (469) may complement the left edge (93) of the face shield (90) so that the left sound attenuation structure (450) height-wise lies substantially parallel (+/−20 degrees) to the axial axis (84) of the PAPR user's head. This allows for the left sound attenuation structure (450) to provide optimal sound attenuation. For example, a left sound attenuation structure (450) with a triangular length-wise cross section would complement a triangular left edge (93) of the face shield (90).

The barrier (470) may have a solid composition.

Alternatively, the barrier (470) may have a hollow composition. When the barrier (470) has a hollow composition, it comprises a front wall (480), a back wall (485), and one or more cavities (484). The front wall (480) and the back wall (485) may have a flat profile, a curved profile, or a combination of flat and curved profiles. The barrier (470) may further comprise one or more inner walls (475), which join the front wall (480) to the back wall (485) to provide structural support, creating a plurality of cavities (484). The one or more inner walls (475) are located within the barrier (470). FIG. 15 shows a perspective top view of the left sound attenuation structure (450), where the inner wall (475) joins the front wall (480) to the back wall (485), creating two cavities (484).

Figure 20:
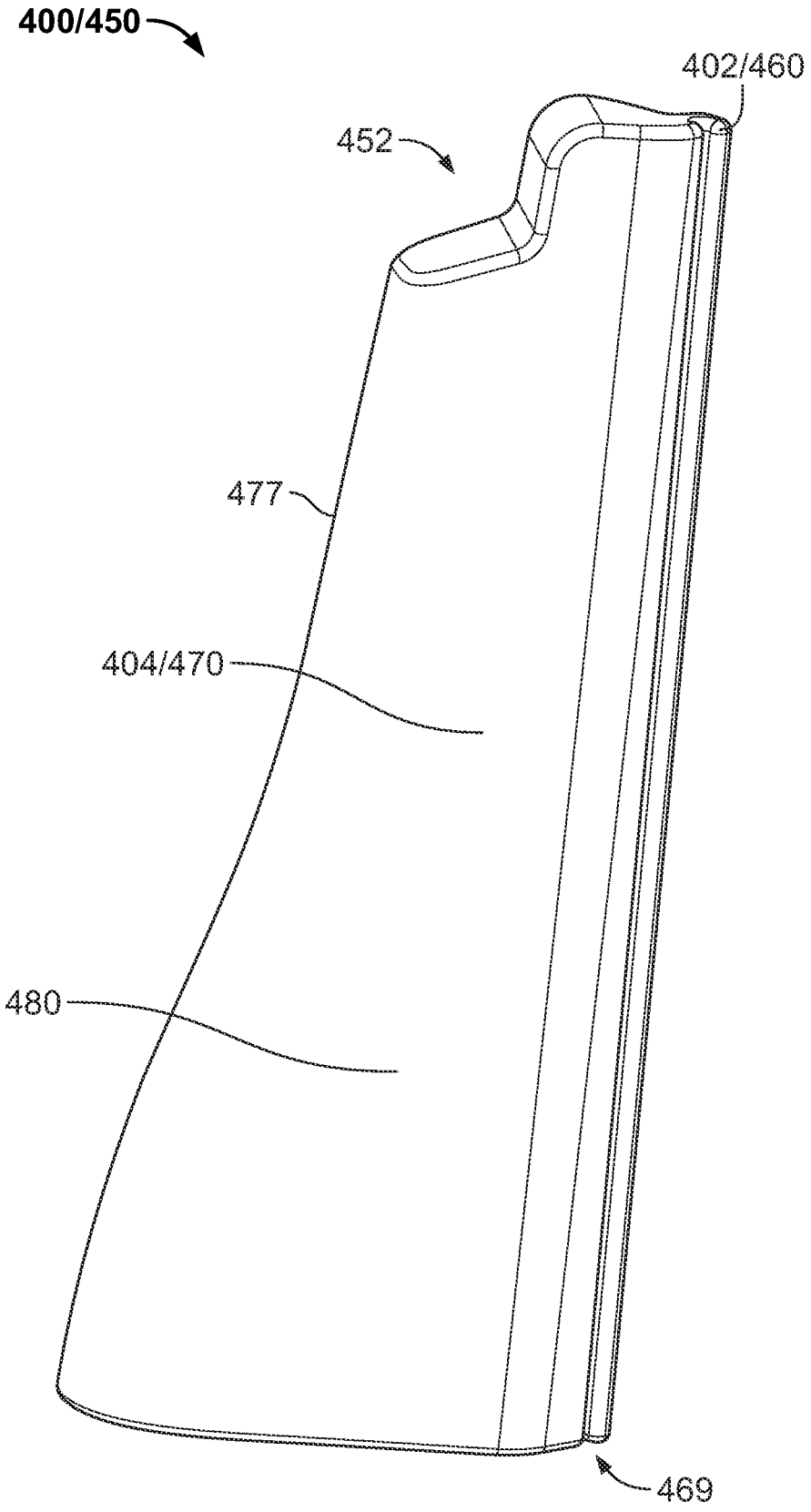
FIG. 20 is a front view of the left sound attenuation structure (450) with a left temple notch (452) on the upper end of the barrier (470)

The barrier (470) may further comprise a side wall (477). The side wall (477) joins the front wall (480) to the back wall (485). FIG. 20 is a front view of the left sound attenuation structure (450) where the barrier (470) has a side wall (477)

The barrier (470) may taper from the bottom end of the barrier (470) towards the top end of the barrier (470). This tapering follows the contour of a human face and allows for a close fit between the PAPR user's face and the barrier (470). This tapering minimizes the space between the PAPR user's face and the barrier (470) that transmits sound towards the left ear of the PAPR user. FIG. 20 is a front view of the left sound attenuation structure (450) with a barrier (470) tapering from the bottom end of the barrier (470) towards the upper end of the barrier (470).

Because of the close fit between the barrier (470) and the PAPR user's face, the barrier (430) makes difficult the use of eyeglasses with the PAPR Frame (100). To allow the use of eyeglasses, the barrier (470) may further comprise a left temple notch (452), located on the upper right corner of the barrier (470). The eyeglasses' left temple is placed through the left temple notch (452). FIG. 20 is a front view of the left sound attenuation structure (450) with a left temple notch (452) on the upper right corner of the barrier (470).

3.3 Other Considerations

Another benefit of the sound attenuation structure (400) is additional protection from a patient's exhaled breath due to the close fitting of the sound attenuation structure (400) to the PAPR user's head. With the sound attenuation structure (400) fastened on both sides of the face shield (90), it increases the cage effect, creating a more complete environment where the air supply is more protective.

4 Problems Addressed by the PAPR Frame (100)

Issue #1: The PAPR Device (102) is easy to both clean and maintain. The PAPR Device (102) is comprised of the PAPR Frame (100), a hat (80), and a face shield (90). These elements are easy to take apart, to clean, and to maintain. There are no moving pieces in the PAPR Device (102), reducing maintenance to the occasional surface cleaning. The tubing segments (300) can also easily cleaned, depending on the material selected.

Issue #2: The PAPR Device (102) does not limit the PAPR user's range of vision. The face shield (90) is a transparent piece of bendable material, preferably plastic, that does not limit the PAPR user's field of vision. There are no other elements that limit the PAPR user's range of vision.

Issue #3: The PAPR Device (102) eliminates battery charging requirements. The air source (320) providing air to the PAPR Device (102) procures its energy requirements from an energy source remote of where the PAPR user is located.

Issue #4: The PAPR Device (102) eliminates the need for filters and the periodic replacement of these filters. The air source (320) providing air to the PAPR Device (102) is preferentially remote of where the PAPR user is located so the air source (320) supplies non-compromised clean and dry air that does not require the need for filters. If there is a need for an air filter (330), the replacement of the air filter (330) is done at the air source (320) location, vastly simplifying the maintenance of the air source (320) and the air filters (330).

Issue #5: The PAPR Device (102) is comprised of elements that minimize replacement costs if the PAPR is damaged. The PAPR Device (102) is comprised of three elements that are fastened together. If any one element is damaged, it can be replaced independently of the other elements. If the face shield (90) is damaged, a new face shield (90) can be inserted to the PAPR Frame (100). If the hat (80) is soiled, the soiled hat (80) can be quickly removed and a new hat (80) can be inserted to the PAPR Frame (100).

Issue #6: The PAPR Device (102) is light weight and comfortable to be worn. The PAPR user uses a hat (80) with a visor (82) that seats comfortably over the head of the PAPR user. For instance, the PAPR user can fasten his/her favorite baseball cap or tennis visor to the PAPR Frame (100).

Issue #7: The PAPR Device (102) provides for a sense of openness. The transparency of the face shield (90) allows an open view that minimizes the sense of claustrophobia.

Issue #8: The PAPR Device (102) is simple to put on and wear. The assembling of the PAPR Device (102) consists of three simple steps. First, an upper portion (94) of the face shield (90) is inserted into the face shield receiving slot (260) and inserted between the inner surfaces (222) of the front curved band segments (220) and the inner surface (212) of the back curved band (210). Second, the visor (82) of the hat (80) inserts into the visor receiving slot (150) and inserted between the lower surface (118) of the top curved piece (110) and the upper surface (136) of the bottom curved piece (130). Third, tubing segments (300) are inserted through each tubing aperture (164) into the protected breathing space (96) enclosed by the PAPR Frame (100).

Issue #9: The PAPR design allows for a large space for the PAPR user to wear large volume head pieces such as headlamps and magnifying equipment. Because the visor (82) of the hat (80) inserts into the PAPR Frame (100), a large open space exists between the PAPR user's face and the face shield (90). This large open space allows for the PAPR user to utilize head pieces such as headlamps and magnifying equipment.

5 Clarifying Comments

While the foregoing written description of the invention enables a person having ordinary skill in the art to make and use what is considered presently to be the best mode thereof, those of ordinary skill in the art will understand and appreciate the existence of variations, combinations, and equivalents of the specific embodiment, process, and examples herein. The invention should, therefore, not be limited by the above described embodiment, process, and examples, but by all embodiments and processes within the scope and spirit of the invention.

I claim:

1. A powered air-purifying respirator (PAPR) frame, which allows for the insertion of a visor of a hat and a face shield, comprising:

(a) a top curved piece; the top curved piece comprising:
- (i) a front edge;
- (ii) a back edge;
- (iii) a right edge;
- (iv) a left edge;
- (v) a lower surface;
- (vi) an upper surface; and
- (vii) one or more tubing apertures; where the one or more tubing apertures are oriented between the upper surface and the lower surface of the top curved piece, (b) a bottom curved piece; the bottom curved piece comprising:
- (i) a front edge;
- (ii) a back edge;
- (iii) a right edge;
- (iv) a left edge;
- (v) a lower surface; and
- (vi) an upper surface;

(c) a rim; and (d) a support structure, the support structure comprising:
- (i) a back curved band; the back curved band comprising
  - (1) an inner surface; the inner surface comprising: one or more rivets; and one or more protrusions; where the one or more rivets and one or more protrusions are joined to the inner surface of the back curved band;
  - (2) an outer surface;
- (ii) a plurality of front curved band segments, each front curved band segment comprising:
  - (1) an inner surface; and
  - (2) an outer surface;
- (iii) where the back curved band is joined to the front curved band segments forming a U-shape, (e) where the front edge, the right edge, and the left edge of the top curved piece are joined to the outer surface of the back curved band, (f) where the rim joins the front edge, the right edge, and the left edge of the bottom curved piece to the front edge, the right edge, and the left edge of the top curved piece, (g) where the rim and the outer surface of the back curved band form a channel, (h) where the one or more tubing apertures are located on the top curved piece so that the tubing apertures on the lower surface of the top curved piece face the channel, (i) where the one or more tubing apertures allows for the insertion of tubing segments that emerge from the lower surface of the top curved piece, (j) where the visor of the hat is inserted between the lower surface of the top curved piece and (k) where the face shield is inserted between the inner surfaces of the front curved band segments and the inner surface of the back curved band, and (l) where the face shield is fastened to the one or more rivets and the one or more protrusions.

2. The PAPR frame described in claim 1, (a) wherein the top curved piece further comprising: a projection corresponding to each tubing aperture, each projection comprising a hollow;

(b) where each projection is joined to the upper surface of the top curved piece, and (c) where each tubing aperture is concentric to the hollow of the corresponding projection.

3. The PAPR frame described in claim 2, (a) where each projection is joined to the outer surface of the back curved band.

4. A powered air-purifying respirator (PAPR) frame, which allows for the insertion of a visor of a hat and a face shield, comprising: supply to a protected breathing space created when the PAPR device is worn by a user, comprising:

(a) a PAPR frame, the PAPR frame comprising:
- (i) a top curved piece; the top curved piece comprising:
  - (1) a front edge;
  - (2) a back edge;
  - (3) a right edge;
  - (4) a left edge;
  - (5) a lower surface;
  - (6) an upper surface; and
  - (7) one or more tubing apertures; where the one or more tubing apertures are oriented between the upper surface and the lower surface of the top curved piece,
- (ii) a bottom curved piece; the bottom curved piece comprising:
  - (1) a front edge;
  - (2) a back edge;
  - (3) a right edge;
  - (4) a left edge;
  - (5) a lower surface; and
  - (6) an upper surface;
- (iii) a rim; and
- (iv) a support structure, the support structure comprising:
  - (1) a back curved band; the back curved band comprising:
    - (a) an inner surface; the inner surface comprising: one or more rivets; and one or more protrusions; where the one or more rivets and one or more protrusions are joined to the inner surface of the back curved band;
    - (b) an outer surface;
  - (2) a plurality of front curved band segments, each front curved band segment comprising:
    - (a) an inner surface; and
    - (b) an outer surface;
  - (3) where the front edge, the right edge, and the left edge of the top curved piece are joined to the outer surface of the back curved band,
  - (4) where the front edge, the right edge, and the left edge of the bottom curved piece are joined to the front edge, the right edge, and the left edge of the top curved piece by the rim,
  - (5) where the rim and the outer surface of the back curved band form a channel,
- (v) where the one or more tubing apertures are located on the top curved piece so that the tubing apertures on the lower surface of the top curved piece face the channel,
- (vi) where the visor of the hat is inserted between the lower surface of the top curved piece and the upper surface of the bottom curved piece, (b) a face shield;
(i) where the face shield is inserted between the inner surfaces of the front curved band segments and the inner surface of the back curved band,
(ii) where the face shield is fastened to the one or more rivets and the one or more protrusions.

5. The PAPR device described in claim 4, the PAPR Device further comprising:
(a) tubing segments; where the tubing segments are inserted into the one or more tubing apertures and emerge from the lower surface of the top curved piece, allowing the air supply to be provided into the protected breathing space,
(b) tubing connectors; where the tubing connectors connect the tubing segments together, and
(c) an air supply regulator; where the air supply regulator connects the tubing segments together and regulates the air supply provided through the tubing segments.

6. The PAPR device described in claim 5, the PAPR Device further comprising:
(a) an air source;
(b) where the air source is connected to the tubing segments that allow the air supply to the protected breathing space.

7. The PAPR device described in claim 6,
(a) wherein the air source comprises an air filter; where the air filter filters the air supply provided through the tubing segments.

8. The PAPR device described in claim 4,
(a) wherein the top curved piece further comprising: a projection corresponding to each tubing aperture, each projection comprising: a hollow;
(b) where each projection is joined to the upper surface of the top curved piece,
(c) where each tubing aperture is concentric to the hollow of the corresponding projection.

9. The PAPR device described in claim 8,
(a) where each projection is joined to the outer surface of the back curved band.

10. The PAPR device described in claim 8, the PAPR Device further comprising:
(a) tubing segments; where the tubing segments are inserted into the one or more tubing apertures and provide the air supply to the protected breathing space,
(b) tubing connectors; where the tubing connectors connect the tubing segments together, and
(c) an air supply regulator; where the air supply regulator connects the tubing segments together and regulates the air supply provided through the tubing connectors.

11. The PAPR device described in claim 10, the PAPR Device further comprising:
(a) an air source;
(b) where the air source is connected to the tubing segments that provide the air supply to the protected breathing space.

12. The PAPR device described in claim 11,
(a) wherein the air source comprises an air filter; where the air filter filters the air supply provided through the tubing segments.

13. A powered air-purifying respirator (PAPR) device, which allows for the insertion of a visor of a hat and allows for provision of an air supply to a protected breathing space created when the PAPR device is worn by a user, comprising:
(a) a PAPR frame, the PAPR frame comprising:
(i) a top curved piece; the top curved piece comprising:
(1) a front edge;
(2) a back edge;
(3) a right edge;
(4) a left edge;
(5) a lower surface;
(6) an upper surface; and
(7) one or more tubing apertures; where the one or more tubing apertures are oriented between the upper surface and the lower surface of the top curved piece,
(ii) a bottom curved piece; the bottom curved piece comprising:
(1) a front edge;
(2) a back edge;
(3) a right edge;
(4) a left edge;
(5) a lower surface; and
(6) an upper surface;
(iii) a rim; and
(iv) a support structure, the support structure comprising:
(1) a back curved band; the back curved band comprising:
(a) an inner surface; the inner surface comprising: one or more rivets; and one or more protrusions; where the one or more rivets and one or more protrusions are joined to the inner surface of the back curved band;
(b) an outer surface;
(2) a plurality of front curved band segments, each front curved band segment comprising:
(a) an inner surface; and
(b) an outer surface;
(3) where the front edge, the right edge, and the left edge of the top curved piece are joined to the outer surface of the back curved band,
(4) where the front edge, the right edge, and the left edge of the bottom curved piece are joined to the front edge, the right edge, and the left edge of the top curved piece by the rim,
(5) where the rim and the outer surface of back curved band form a channel,
(v) where the one or more tubing apertures are located on the top curved piece so that the tubing apertures on the lower surface of the top curved piece face the channel,
(vi) where the visor of the hat is inserted between the lower surface of the top curved piece and the upper surface of the bottom curved piece,
(b) a right sound attenuation structure; the right sound attenuation structure comprising:
(i) a clip; the clip comprising:
(1) a left leg;
(2) a right leg; and
(3) a slot formed between the left leg and the right leg;
(ii) a barrier;
(iii) where the barrier is joined to the clip,
(iv) where the barrier abuts against the left leg of the clip;
(c) a left sound attenuation structure; the left sound attenuation structure comprising:
(i) a clip; the clip comprising:
(1) a left leg;
(2) a right leg; and
(3) a slot formed between the left leg and the right leg;
(ii) a barrier;

(iii) where the barrier is joined to the clip
(iv) where the barrier abuts against the right leg of the clip.

14. The PAPR device described in claim 13,
(a) a face shield;
(i) where the face shield is inserted between the inner surfaces of the front curved band segments and the inner surface of the back curved band,
(ii) where the face shield is fastened to the one or more rivets and the one or more protrusions.

15. The PAPR device described in claim 13,
(a) wherein the left sound attenuation structure further comprising:
(i) a plurality of support ridges;
(ii) where some of the support ridges are joined to left leg of the clip of the left sound attenuation structure,
(iii) where some of the support ridges are joined to the right leg of the clip of the left sound attenuation structure,
(b) wherein the right sound attenuation structure further comprising:
(i) a plurality of support ridges;
(ii) where some of the support ridges are joined to left leg of the clip of the right sound attenuation structure,
(iii) where some of the support ridges are joined to the right leg of the clip of the right sound attenuation structure.

16. The PAPR device described in claim 13,
(a) wherein the barrier of the left sound attenuation structure further comprising:
(i) an upper right corner; and
(ii) a temple notch;
(iii) where the temple notch is located on the upper right corner of the barrier,
(iv) where a first temple of a pair of glasses is placed through the temple notch of the left sound attenuation structure,
(b) wherein the barrier of the right sound attenuation structure further comprising:
(i) an upper left corner; and
(ii) a temple notch;
(iii) where the temple notch is located on the upper left corner of the barrier,
(iv) where a second temple of the pair of glasses is placed through the temple notch of the right sound attenuation structure.

17. The PAPR device described in claim 13,
(a) wherein the barrier of the left sound attenuation structure further comprising:
(i) a top end; and
(ii) a bottom end;
(iii) where the barrier of the left sound attenuation structure tapers from the bottom end of the barrier of the left sound attenuation structure towards the top end of the barrier of the left sound attenuation structure,
(b) wherein the barrier of the right sound attenuation structure further comprising:
(i) a top end; and
(ii) a bottom end;
(iii) where the barrier of the right sound attenuation structure tapers from the bottom end of the barrier of the right sound attenuation structure towards the top end of the barrier of the right sound attenuation structure.

18. The PAPR device described in claim 14,
(a) wherein the left sound attenuation structure further comprising:
(i) a plurality of support ridges;
(ii) where some of the support ridges are joined to left leg of the clip of the left sound attenuation structure,
(iii) where some of the support ridges are joined to the right leg of the clip of the left sound attenuation structure,
(b) wherein the right sound attenuation structure further comprising:
(i) a plurality of support ridges;
(ii) where some of the support ridges are joined to left leg of the clip of the right sound attenuation structure,
(iii) where some of the support ridges are joined to the right leg of the clip of the right sound attenuation structure.

19. The PAPR device described in claim 14,
(a) wherein the barrier of the left sound attenuation structure further comprising:
(i) an upper right corner; and
(ii) a temple notch;
(iii) where the temple notch is located on the upper right corner of the barrier,
(iv) where a first temple of a pair of glasses is placed through the temple notch of the left sound attenuation structure,
(b) wherein the barrier of the right sound attenuation structure further comprising:
(i) an upper left corner; and
(ii) a temple notch;
(iii) where the temple notch is located on the upper left corner of the barrier,
(iv) where a second temple of the pair of glasses is placed through the temple notch of the right sound attenuation structure.

20. The PAPR device described in claim 14,
(a) wherein the barrier of the left sound attenuation structure further comprising:
(i) a top end; and
(ii) a bottom end;
(iii) where the barrier of the left sound attenuation structure tapers from the bottom end of the barrier of the left sound attenuation structure towards the top end of the barrier of the left sound attenuation structure,
(b) wherein the barrier of the right sound attenuation structure further comprising:
(i) a top end; and
(ii) a bottom end;
(iii) where the barrier of the right sound attenuation structure tapers from the bottom end of the barrier of the right sound attenuation structure towards the top end of the barrier of the right sound attenuation structure.

* * * * *